US011035601B2

(12) United States Patent
Jeong et al.

(10) Patent No.: US 11,035,601 B2
(45) Date of Patent: Jun. 15, 2021

(54) REFRIGERATOR

(71) Applicant: Samsung Electronics Co., Ltd., Suwon-si (KR)

(72) Inventors: Jin Jeong, Yongin-si (KR); Yong Sung Yoon, Suwon-si (KR); Chang Uo Hong, Hwaseong-si (KR); Bong Su Son, Cheonan-si (KR); Young Il Song, Suwon-si (KR); Min Seob Yook, Suwon-si (KR); Do Yun Jang, Suwon-si (KR); Moon Gyo Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/051,127

(22) Filed: Feb. 23, 2016

(65) Prior Publication Data

US 2016/0252286 A1 Sep. 1, 2016

(30) Foreign Application Priority Data

Feb. 27, 2015 (KR) ..... 10-2015-0028610

(51) Int. Cl.
*F25C 1/18* (2006.01)
*F25C 1/04* (2018.01)
(Continued)

(52) U.S. Cl.
CPC ..... *F25C 1/18* (2013.01); *F25C 1/04* (2013.01); *F25C 1/24* (2013.01); *F25C 5/04* (2013.01);
(Continued)

(58) Field of Classification Search
CPC ..... F25C 1/18; F25C 1/04; F25C 1/24; F25C 2400/06; F25C 2700/12; F25C 2700/14;
(Continued)

(56) References Cited

U.S. PATENT DOCUMENTS 2,319,523 A 5/1943 Trigg
2,844,008 A * 7/1958 Barton ..... F25C 1/04 62/135
(Continued)

FOREIGN PATENT DOCUMENTS

CN 102116564 A 7/2011
CN 103582790 A 2/2014
(Continued)

OTHER PUBLICATIONS

Partial English Machine Translation: KR 10-2012-0011162. Accessed Sep. 2017.*
(Continued)

*Primary Examiner* — Tavia Sullens
(74) *Attorney, Agent, or Firm* — Staas & Halsey LLP

(57) ABSTRACT

A refrigerator that includes a main body, an ice-making chamber formed inside the main body, an ice-making tray to store ice-making water and generate ice, and a refrigerant pipe installed so that at least a part thereof is in contact with the ice-making tray, wherein a refrigerant flows in the refrigerant pipe, wherein the ice-making tray includes an ice-making cell that stores ice-making water, and a temperature sensor accommodation portion that accommodates a temperature sensor that measures temperature of water or ice stored in the ice-making cell, and the temperature sensor accommodation portion includes an accommodation portion that is formed in a groove shape, and has an open upper side so that the temperature sensor moves in or out, and a fixing portion which is coupled to a wire connected to a part of the temperature sensor or to the temperature sensor and fixes a position of the temperature sensor.

20 Claims, 23 Drawing Sheets

(51) Int. Cl.

| | |
|---|---|
| ***F25C 1/24*** | (2018.01) |
| ***F25C 5/20*** | (2018.01) |
| ***F25C 5/04*** | (2006.01) |

(52) U.S. Cl.
CPC ..... *F25C 5/22* (2018.01); *F25C 2400/06* (2013.01); *F25C 2700/12* (2013.01); *F25C 2700/14* (2013.01)

(58) Field of Classification Search
CPC .... F25C 5/005; F25C 5/02; F25C 5/04; F25C 5/06; F25C 5/08; F25C 5/10; F25C 2700/06; F25C 5/22; F25C 5/24; F25C 5/187; F25C 5/185
See application file for complete search history.

(56) References Cited

U.S. PATENT DOCUMENTS

| | | | | |
|---|---|---|---|---|
| 4,649,717 | A * | 3/1987 | Tate, Jr. | F25C 1/04 29/854 |
| 5,182,916 | A | 2/1993 | Oike et al. | |
| 2006/0266055 | A1 | 11/2006 | Anderson et al. | |
| 2008/0156022 | A1 | 7/2008 | Leclear et al. | |
| 2011/0000248 | A1 | 1/2011 | Jeong et al. | |
| 2011/0162406 | A1* | 7/2011 | Shin | F25C 1/24 62/351 |
| 2013/0167575 | A1* | 7/2013 | Hong | F25C 5/005 62/344 |
| 2016/0245574 | A1* | 8/2016 | Jeong | F25D 21/14 |

FOREIGN PATENT DOCUMENTS

| | | | | |
|---|---|---|---|---|
| JP | H03158676 | A | 7/1991 | |
| JP | 2000-249437 | | 9/2000 | |
| JP | 2012255579 | A * | 12/2012 | F25C 1/24 |
| KR | 10-0182728 | | 5/1999 | |
| KR | 10-2011-0080104 | | 7/2011 | |
| KR | 1020120011162 | A | 7/2012 | |
| KR | 10-2013-0078531 | | 7/2013 | |
| WO | 2012169567 | A1 | 12/2012 | |
| WO | WO-2015056977 | A1 * | 4/2015 | F25C 1/18 |

OTHER PUBLICATIONS

Partial English Machine Translation: JP 2012255579. Accessed Sep. 2017.*
Communication pursuant to Article 94(3) EPC dated Apr. 21, 2017 corresponding to European Application No. 16153197.5.
Correspondence with Partial European Search Report dated Jul. 12, 2016 corresponding to European Application No. 16153197.5.
Correspondence with extended European Search Report dated Nov. 17, 2016 corresponding to European Application No. 16153197.5.
Communication under Rule 71(3) EPC dated Jan. 19, 2018 corresponding to European Patent Application No. 16153197.5.
Notification of the First Office Action dated Jan. 18, 2018 corresponding to Chinese Patent Application No. 201610112035.3.
Chinese Patent Office Action issued Notification of Due Registration (Decision on Grant) in Chinese Patent Application No. 201610112035.3 dated Sep. 5, 2018 (4 total pages).
Korean Office Action dated Jan. 14, 2021 in Korean Patent Application No. 10-2015-0028610.

* cited by examiner

REFRIGERATOR

RELATED APPLICATION(S)

This application claims the benefit of Korean Patent Application No. 10-2015-0028610, filed on Feb. 27, 2015 in the Korean Intellectual Property Office, the disclosure of which is incorporated herein by reference.

BACKGROUND

Embodiments of the present disclosure relate to a refrigerator having an ice-making tray which stores ice-making water, cools the ice-making water, and generates ice.

In general, a refrigerator is an apparatus that includes storage chambers and a cold air supply unit that supplies cold air to the storage chambers, and stores food freshly. A refrigerator may further include an ice-making chamber and an ice-making apparatus for generating ice.

An automatic ice-making apparatus includes an ice-making tray that stores ice-making water, an ejector that separates ice made by the ice-making tray, an ice-ejecting heater that heats the ice-making tray when the ice is separated from the ice-making tray, and an ice bucket that stores the ice separated from the ice-making tray.

Among ice-making methods for cooling ice-making water, a direct cooling method has a refrigerant pipe provided to extend inside an ice-making chamber for cooling ice-making water and to be in contact with an ice-making tray. In such a direct cooling method, an ice-making tray receives cooling energy from a refrigerant pipe by thermal conduction. Accordingly, the direct cooling method has a merit in that a cooling speed of ice-making water is fast. However, when the cooling speed of ice-making water is excessively fast, ice that is not transparent and is turbid is generated.

SUMMARY

Therefore, it is an aspect of the present disclosure to provide an ice-making tray capable of generating ice of which transparency is improved by decreasing conductivity of cooling energy slightly, and a refrigerator having the same. Here, the ice-making tray is in contact with a refrigerant pipe, receives a cooling energy from the refrigerant pipe by thermal conduction, and generates ice. At this time, the efficiency of a cooling function of an ice-making chamber by the ice-making tray, that is, the function in which the ice-making tray cools the ice-making chamber while exchanging heat with air in the ice-making chamber, does not decrease.

It is another aspect of the present disclosure to provide an integrated ice-making tray in which the ice-making tray and related parts of the ice-making tray are integrated.

It is still another aspect of the present disclosure to provide an ice-making tray having an improved structure capable of fixing a position of a temperature sensor which measures temperature of water or ice accommodated in an ice-making cell.

It is yet another aspect of the present disclosure to provide a refrigerator having an improved structure in which a drain duct rotatably coupled to an ice-making tray rotates in a predetermined range.

It is yet another aspect of the present disclosure to provide a refrigerator having an improved structure in which cooling energy transferred from a refrigerant pipe uniformly transfers to an ice-making tray.

It is yet another aspect of the present disclosure to provide a refrigerator having an improved structure capable of preventing an ice-ejecting motor coupled to an ice-making tray from sagging.

Additional aspects of the disclosure will be set forth in part in the description which follows and, in part, will be obvious from the description, or may be learned by practice of the disclosure.

In accordance with one aspect of the present disclosure, a refrigerator includes a main body, an ice-making chamber formed inside the main body, an ice-making tray installed inside the ice-making chamber, wherein ice-making water is stored and ice is generated in the ice-making tray, and a refrigerant pipe installed so that at least a part thereof is in contact with the ice-making tray, wherein a refrigerant flows in the refrigerant pipe, wherein the ice-making tray includes an ice-making cell that stores ice-making water, and a temperature sensor accommodation portion that accommodates a temperature sensor that measures temperature of water or ice stored in the ice-making cell, and the temperature sensor accommodation portion includes an accommodation portion that is formed in a groove shape and has an open upper side so that the temperature sensor moves in or out, and a fixing portion which is coupled to a wire connected to a part of the temperature sensor or the temperature sensor and fixes a position of the temperature sensor.

The temperature sensor accommodation portion may further include a connecting portion that is provided as a path through which the wire connected to the temperature sensor extends toward an outside of the ice-making tray, and the fixing portion may be formed to be bent toward one side of the accommodation portion.

An ice-making water contact portion, of which at least a part of a side surface facing the ice-making cell is open, may be formed at the temperature sensor accommodation portion, and the connecting portion may be formed to extend in a direction opposite to the ice-making water contact portion.

The ice-making tray may further include a first tray in contact with the refrigerant pipe to receive cooling energy from the refrigerant pipe, and a second tray coupled to overlap a top surface of the first tray to receive cooling energy from the first tray, and formed of a material having thermal conductivity lower than that of the first tray, wherein the ice-making cell is formed in the second tray.

The temperature sensor accommodation portion may be formed at a position facing the ice-making cell in the second tray.

The refrigerant pipe may include a first refrigerant pipe that extends in a length direction of the ice-making tray, a second refrigerant pipe disposed in parallel to the first refrigerant pipe, and a third refrigerant pipe that connects the first refrigerant pipe and the second refrigerant pipe, and has a U shape, and the ice-making tray may include a protrusion formed on a bottom surface thereof so that the third refrigerant pipe is spaced apart from the ice-making tray.

The protrusion may be formed at a region facing the third refrigerant pipe on the bottom surface of the ice-making tray.

The refrigerator may further include a drain duct coupled to a lower portion of the ice-making tray to collect defrosted water of the ice-making tray, wherein the drain duct may include a hinge-coupling portion coupled to the ice-making tray to rotate around one side of the ice-making tray and to be open, and a rotation limiting portion that limits a range within which the drain duct rotates.

The rotation limiting portion may be formed in a radius of rotation of the drain duct.

The rotation limiting portion may be formed at an inner side surface of the ice-making tray.

The refrigerator may further include an ejector that separates ice from the ice-making tray, and an ice-ejecting motor portion coupled to one side of the ice-making tray, wherein an ice-ejecting motor that rotates the ejector is installed inside the ice-ejecting motor portion, wherein a locking step that protrudes in a side direction may be formed at one side surface of the ice-ejecting motor portion, and a supporting member provided at a position corresponding to the locking step to support the locking step may be formed at the ice-making tray.

The ice-ejecting motor portion may include a screw-coupling portion screw-coupled to the ice-making tray, and the locking step may be formed to be spaced a predetermined gap from the screw-coupling portion to prevent the ice-ejecting motor portion from sagging.

The screw-coupling portion and the locking step may be formed at the same plane of the ice-ejecting motor portion, and a distance between the screw-coupling portion and the ice-making cell may be less than a distance between the locking step and the ice-making cell.

The ice-ejecting motor portion may further include a seating guide provided so that a part of a coupling surface of the ice-making tray coupled to the screw-coupling portion is seated.

The seating guide may include a first seating guide and a second seating guide that respectively support a bottom surface and one side surface of the coupling surface of the ice-making tray coupled to the screw-coupling portion.

In accordance with another aspect of the present disclosure, a refrigerator includes a main body, an ice-making chamber formed inside the main body, an ice-making tray installed inside the ice-making chamber, wherein ice-making water is stored and ice is generated in the ice-making tray, and a refrigerant pipe installed so that at least a part thereof is in contact with the ice-making tray, wherein a refrigerant flows in the refrigerant pipe, wherein the refrigerant pipe includes a first refrigerant pipe that extends in a length direction of the ice-making tray, a second refrigerant pipe disposed in parallel to the first refrigerant pipe, and a third refrigerant pipe that connects the first refrigerant pipe and the second refrigerant pipe, and has a U shape, and the ice-making tray includes a protrusion formed on a bottom surface thereof so that the third refrigerant pipe is spaced apart from the ice-making tray.

The protrusion may be formed at a region facing the third refrigerant pipe on the bottom surface of the ice-making tray.

The ice-making tray may further include a first tray in contact with the refrigerant pipe to receive cooling energy from the refrigerant pipe, and a second tray coupled to overlap a top surface of the first tray to receive cooling energy from the first tray, and formed of a material having thermal conductivity lower than that of the first tray, wherein the ice-making cell is formed in the second tray, and the protrusion may be formed at a region facing the third refrigerant pipe on a bottom surface of the first tray.

In accordance with still another aspect of the present disclosure, a refrigerator includes a main body, an ice-making chamber formed inside the main body, an ice-making tray installed inside the ice-making chamber, wherein ice-making water is stored and ice is generated in the ice-making tray, a refrigerant pipe installed so that at least a part thereof is in contact with the ice-making tray, wherein a refrigerant flows in the refrigerant pipe, and a drain duct that is coupled to a lower portion of the ice-making tray to collect defrosted water of the ice-making tray, wherein the drain duct includes a hinge-coupling portion coupled to the ice-making tray to rotate around one side of the ice-making tray and to be open, and a rotation limiting portion that limits a range within which the drain duct rotates.

The rotation limiting portion may be formed in a radius of rotation of the drain duct in an inner side surface of the ice-making tray.

The ice-making tray may further include a first tray in contact with the refrigerant pipe to receive cooling energy from the refrigerant pipe, and a second tray coupled to overlap a top surface of the first tray to receive cooling energy from the first tray, and formed of a material having thermal conductivity lower than that of the first tray, wherein the ice-making cell is formed in the second tray, and the rotation limiting portion may be formed in a radius of rotation of the drain duct in an inner side surface of the first tray.

In accordance with yet another aspect of the present disclosure, a refrigerator includes a main body, an ice-making chamber formed inside the main body, an ice-making tray installed inside the ice-making chamber, wherein ice-making water is stored and ice is generated in the ice-making tray, a refrigerant pipe installed so that at least a part thereof is in contact with the ice-making tray, wherein a refrigerant flows in the refrigerant pipe, an ejector that separates ice from the ice-making tray, and an ice-ejecting motor portion coupled to one side of the ice-making tray, wherein an ice-ejecting motor that rotates the ejector is installed inside the ice-ejecting motor portion, wherein a screw-coupling portion screw-coupled to the ice-making tray and a locking step that is spaced a predetermined gap from the screw-coupling portion and protrudes toward a side thereof are formed at one side surface of the ice-ejecting motor portion, and a supporting member provided at a position corresponding to the locking step to support the locking step is formed at the ice-making tray.

The ice-making tray may further include a first tray in contact with the refrigerant pipe to receive cooling energy from the refrigerant pipe, and a second tray coupled to overlap a top surface of the first tray to receive cooling energy from the first tray, and formed of a material having thermal conductivity lower than that of the first tray, where in the ice-making cell is formed in the second tray, and the supporting member may be provided at a position corresponding to the locking step of the ice-ejecting motor portion coupled to the second tray.

The ice-ejecting motor portion may further include a seating guide provided so that a part of a coupling surface of the ice-making tray coupled to the screw-coupling portion is seated, and the seating guide may include a first seating guide and a second seating guide that respectively support a bottom surface and one side surface of the coupling surface of the ice-making tray coupled to the screw-coupling portion.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
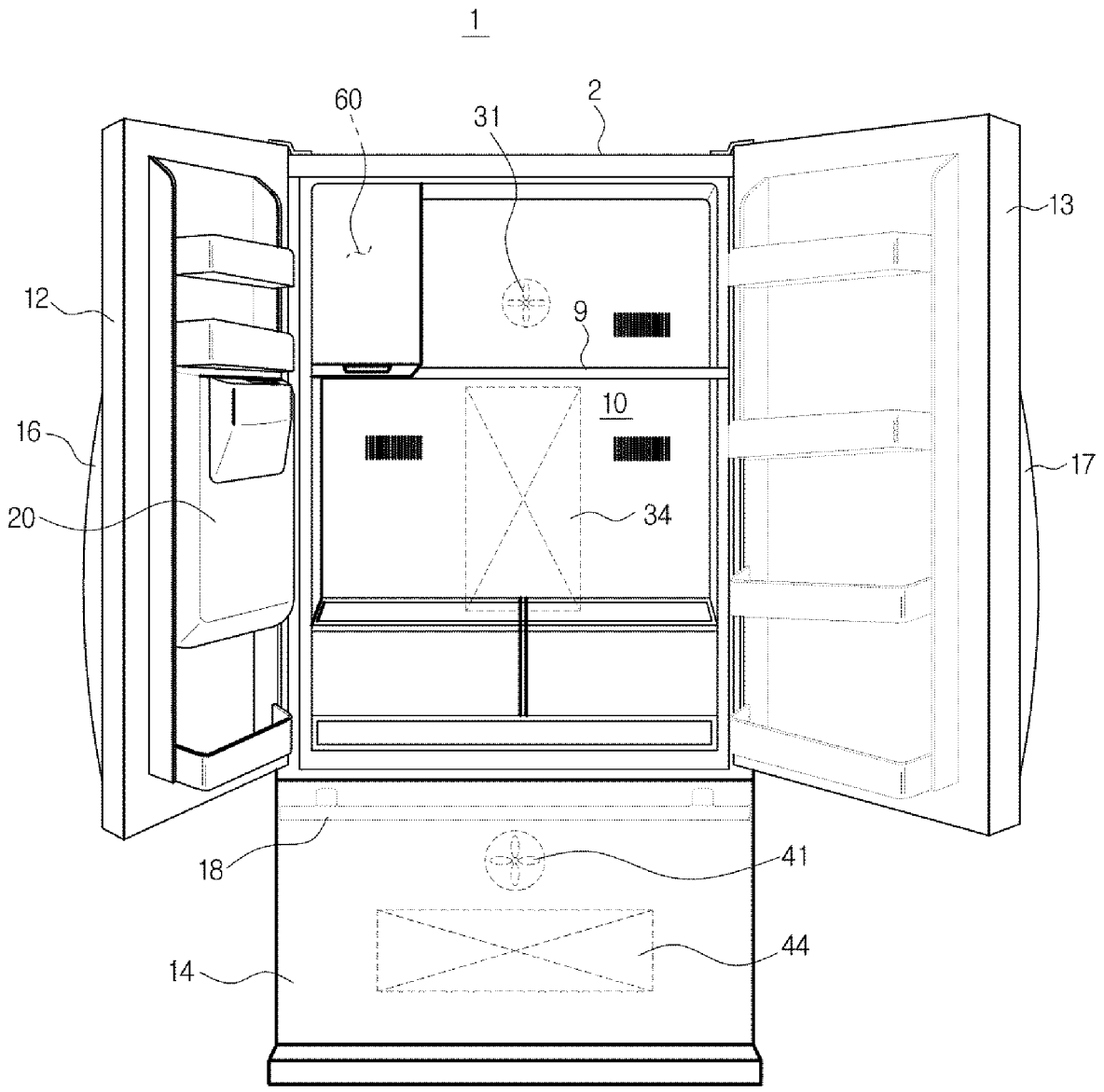
FIG. 1 is a view illustrating an exterior of a refrigerator according to an embodiment of the present disclosure.

Reference will now be made in detail to the embodiments of the present disclosure, examples of which are illustrated in the accompanying drawings, wherein like reference numerals refer to like elements throughout.

Figure 2:
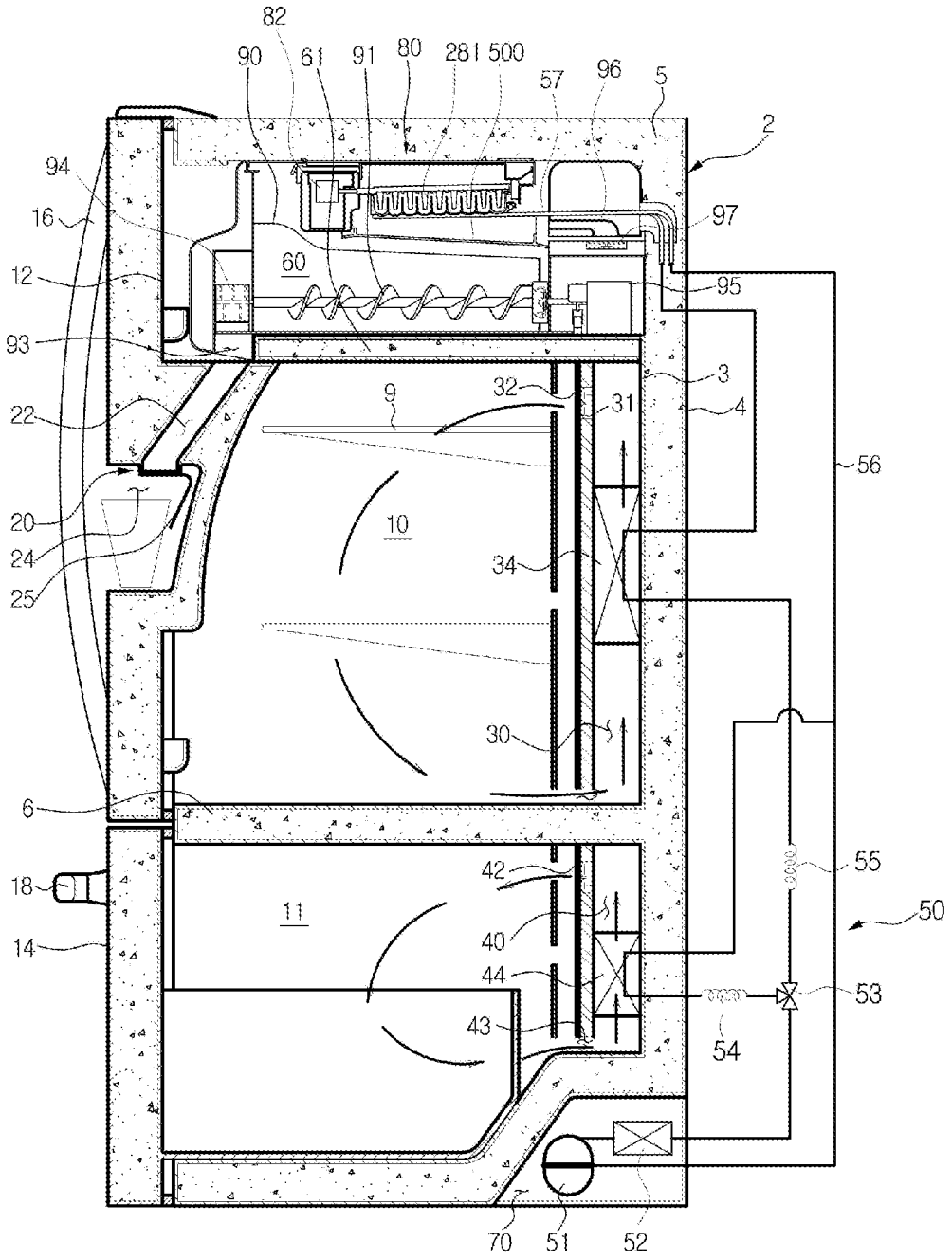
FIG. 2 is a schematic cross-sectional view illustrating an internal structure of the refrigerator of FIG. 1.
Figure 3:
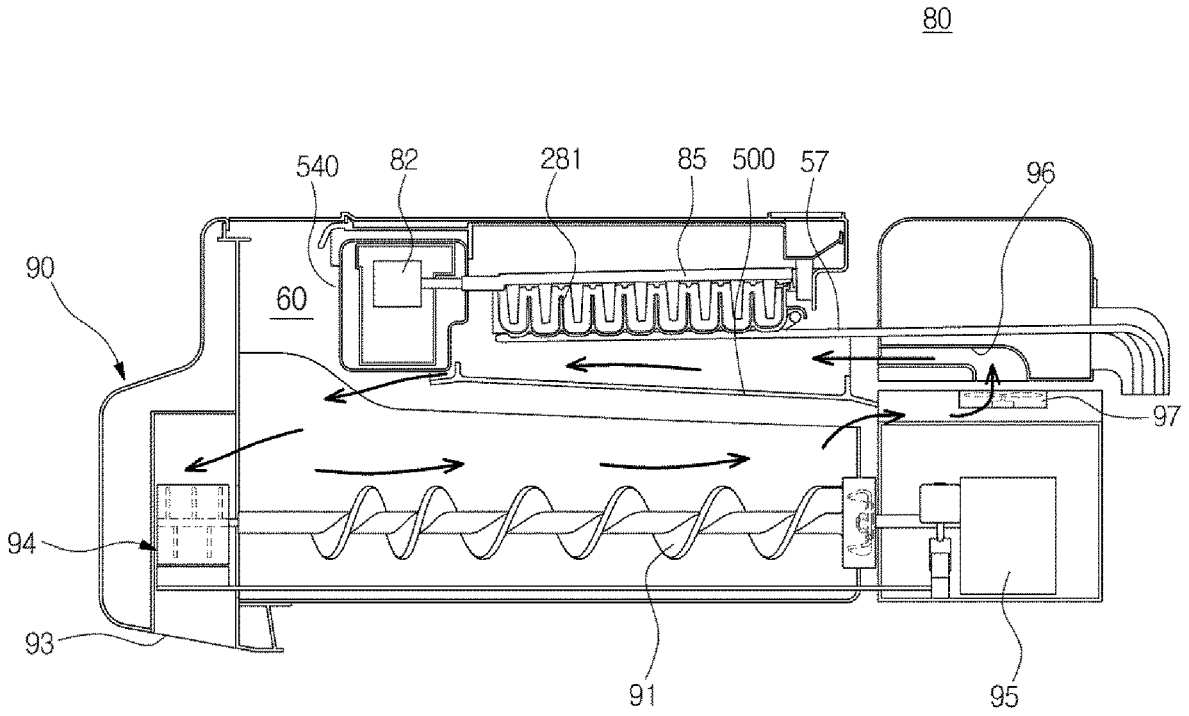
FIG. 3 is a schematic enlarged cross-sectional view illustrating a structure of an ice-making chamber of the refrigerator of FIG. 1.

FIG. 1 is a view illustrating an exterior of a refrigerator according to an embodiment of the present disclosure. FIG. 2 is a schematic cross-sectional view illustrating an internal structure of the refrigerator of FIG. 1. FIG. 3 is a schematic enlarged cross-sectional view illustrating a structure of an ice-making chamber of the refrigerator of FIG. 1.

Referring to FIGS. 1 to 3, a refrigerator 1 according to an embodiment of the present disclosure may include a main body 2, a refrigerator compartment 10 and a freezer compartment 11 capable of keeping food refrigerated or frozen, an ice-making chamber 60 formed to be partitioned off from the refrigerator compartment 10 and the freezer compartment 11 by an ice-making chamber wall 61, and a cooling unit 50 to supply cold air to the refrigerator compartment 10 and the freezer compartment 11 and the ice-making chamber 60.

The main body 2 may include an inner box 3 forming the refrigerator compartment 10 and the freezer compartment 11, an outer box 4 coupled to cover the inner box 3 thus forming an exterior, and an insulating material 5 foamed between the inner box 3 and the outer box 4.

The refrigerator compartment 10 and the freezer compartment 11 may be formed such that a front side thereof is open, and may be partitioned into the refrigerator compartment 10 at an upper side thereof and a freezer compartment 11 at a lower side thereof by a horizontal partition 6. The horizontal partition 6 may include an insulating material configured to block heat exchange between the refrigerator compartment 10 and the freezer compartment 11.

Shelves 9 on which food is put and which vertically divide a storage space of the refrigerator compartment 10 may be disposed in the refrigerator compartment 10. The open front side of the refrigerator compartment 10 may be hinge-coupled to the main body 2, and be opened and closed by a pair of doors 12 and 13 that are rotatable. Handles 16 and 17 configured to open and close the doors 12 and 13 may be respectively provided at the doors 12 and 13.

A dispenser 20 capable of extracting ice from the ice-making chamber 60 to an outside thereof without opening a door 12 may be provided at the door 12. The dispenser 20 may include an extraction space 24 through which ice is extracted, a lever 25 by which ice is determined whether to be extracted or not, and a chute 22 which guides the ice discharged through an ice discharging orifice 93 to the extraction space 24.

An open front side of the freezer compartment 11 may be opened and closed by a sliding door 14 capable of sliding in the freezer compartment 11. A storage box 19 capable of accommodating food may be provided at a rear surface of the sliding door 14. A handle 18 configured to open and close the sliding door 14 may be provided at the sliding door 14.

The cooling unit 50 may include a compressor 51 that compresses a refrigerant using high pressure, a condenser 52 that condenses the compressed refrigerant, expansion units 54 and 55 that expand the refrigerant to low pressure, evaporators 34 and 44 that evaporate the refrigerant and generate cold air, and a refrigerant pipe 56 that guides the refrigerant.

The compressor 51 and the condenser 52 may be disposed in a machine compartment 70 provided at a rear lower side of the main body 2. In addition, the evaporators 34 and 44 may be respectively disposed at a refrigerator compartment cold air supply duct 30 that is provided at the refrigerator compartment 10, and a freezer compartment cold air supply duct 40 that is provided at the freezer compartment 11.

The refrigerator compartment cold air supply duct 30 may include an inlet 33, a cold air discharge orifice 32, and a blower fan 31, and may circulate cold air in the refrigerator compartment 10. In addition, the freezer compartment cold air supply duct 40 may include an inlet 43, a cold air discharge orifice 42, and a blower fan 41, and may circulate cold air in the freezer compartment 11.

The refrigerant pipe 56 may be divided at one dividing position so that a refrigerant flows to the freezer compartment 11 or the refrigerant flows to the refrigerator compartment 10 and the ice-making chamber 60, and a switching valve 53 that switches a flow path of the refrigerant may be installed at the dividing position.

A part of the refrigerant pipe 56 may be disposed inside the ice-making chamber 60 to cool the ice-making chamber 60. The part disposed inside of the ice-making chamber 60 may be in contact with an ice-making tray 281, and may directly supply cooling energy to the ice-making tray 281 by thermal conduction.

Hereinafter, the part of the refrigerant pipe 56 disposed inside the ice-making chamber 60 to be in contact with the ice-making tray 281 is referred as an ice-making chamber refrigerant pipe 57. A refrigerant in a liquid state may pass through the expansion unit 55 to become a low temperature and low pressure state, flow inside the ice-making chamber refrigerant pipe 57 to absorb heat inside the ice-making tray 281 and the ice-making chamber 60, and evaporate in a gas state. Accordingly, the ice-making chamber refrigerant pipe 57 and the ice-making tray 281 may perform a function of an evaporator in the ice-making chamber 60.

An ice maker 80 according to one embodiment of the present disclosure includes the ice-making tray 281 that stores ice-making water, an ejector 84 that separates ice from the ice-making tray 281, an ice-ejecting motor 82 that rotates the ejector 84, an ice-ejecting heater 87 that heats the ice-making tray 281 to eject ice easily when the ice is separated from the ice-making tray 281, an ice bucket 90 that stores ice generated by the ice-making tray 281, a drain duct 500 that collects defrosted water of the ice-making tray 281 and simultaneously guides an air flow inside the ice-making chamber 60, and an ice-making chamber fan 97 that circulates air inside the ice-making chamber 60.

The ice bucket 90 is disposed under the ice-making tray 281 to collect ice that falls from the ice-making tray 281. The ice bucket 90 is provided with an auger 91 that transfers stored ice to the ice discharge orifice 93, an auger motor 95 that drives the auger 91, and a grinding unit 94 capable of grinding ice.

The auger motor 95 may be disposed at a rear of the ice-making chamber 60, and the ice-making chamber fan 97 may be disposed above the auger motor 95. A guiding path 96 which guides air discharged from the ice-making chamber fan 97 toward a front side of the ice-making chamber 60 may be provided above the ice-making chamber fan 97.

Air that forcibly flows by the ice-making chamber fan 97 may circulate inside the ice-making chamber 60 in an arrow direction denoted in FIG. 3. That is, the air discharged upward from the ice-making chamber fan 97 may flow through the guiding path 96 and may flow between the ice-making tray 281 and the drain duct 500. At this time, the air may exchange heat with the ice-making tray 281 and the ice-making chamber refrigerant pipe 57, and the cooled air may flow to a side of the ice discharge orifice 93 of the ice bucket 90 and may be suctioned by the ice-making chamber fan 97.

A lower portion of the ice-making tray 281 according to an embodiment of the present disclosure may include a first tray 300 (see FIG. 2) formed of an aluminum material, which will be described below. Since a heat exchanging rib 380 (see FIG. 6), which expands an area which transfers heat to air inside the ice-making chamber 60, is provided at the first tray 300, the efficiency of exchanging heat of internal air between the ice-making tray 281 and the ice-making chamber 60 is increased, and accordingly, an inside of the ice-making chamber 60 may be efficiently maintained to be cooled and chilled.

Figure 4:
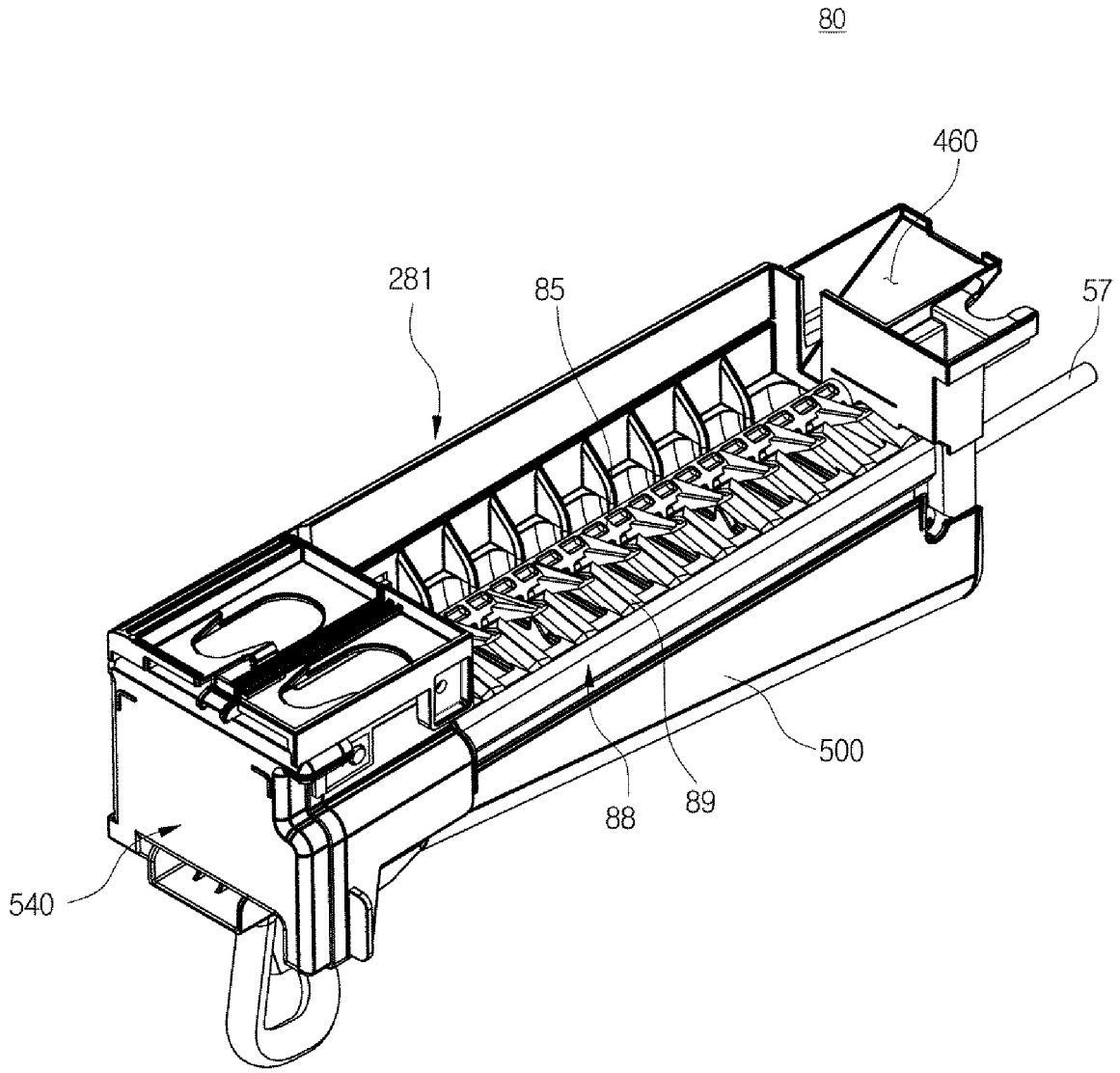
FIG. 4 is a perspective view illustrating an ice maker of the refrigerator of FIG. 1.
Figure 5:
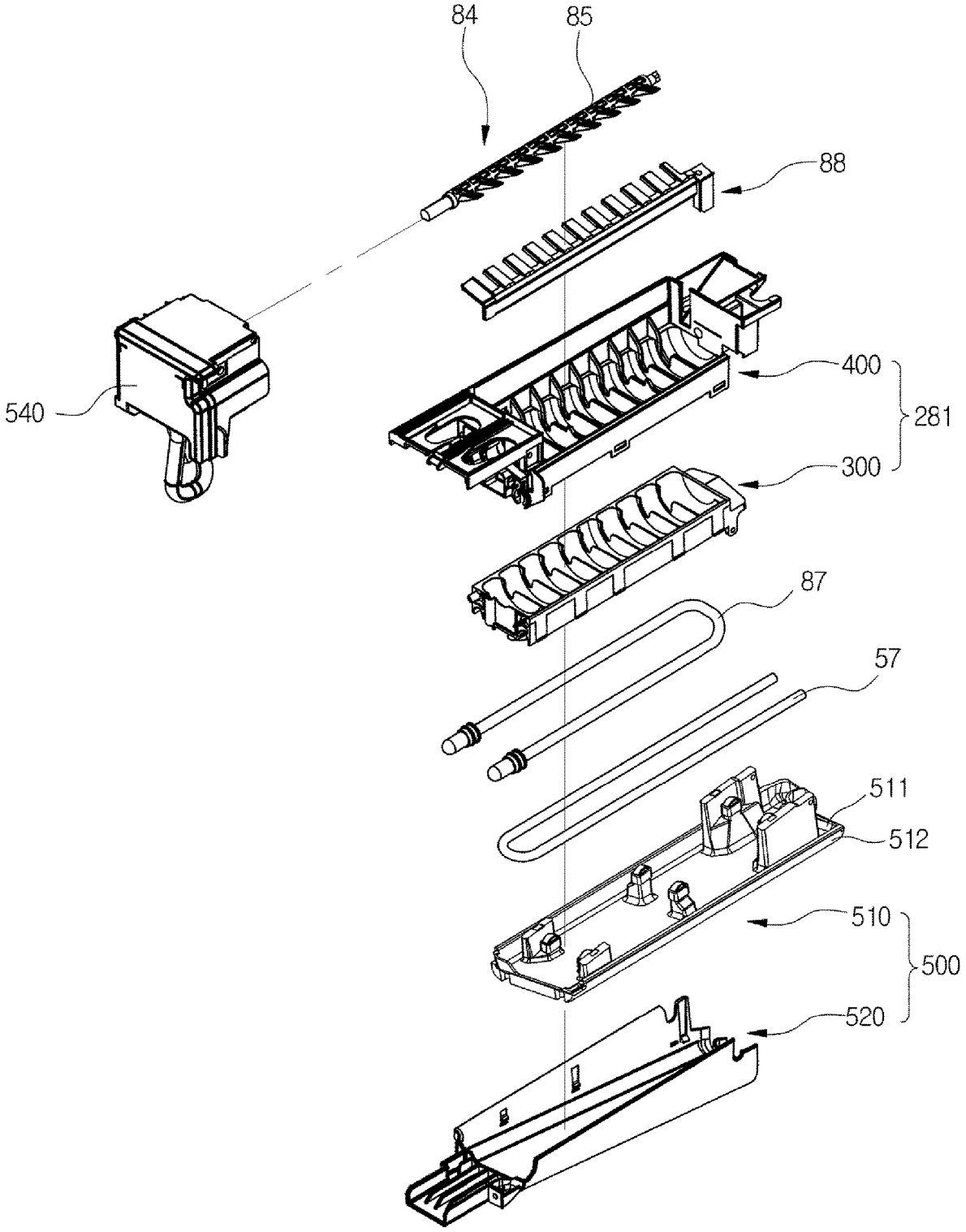
FIG. 5 is an exploded perspective view illustrating the ice maker of FIG. 4.
Figure 6:
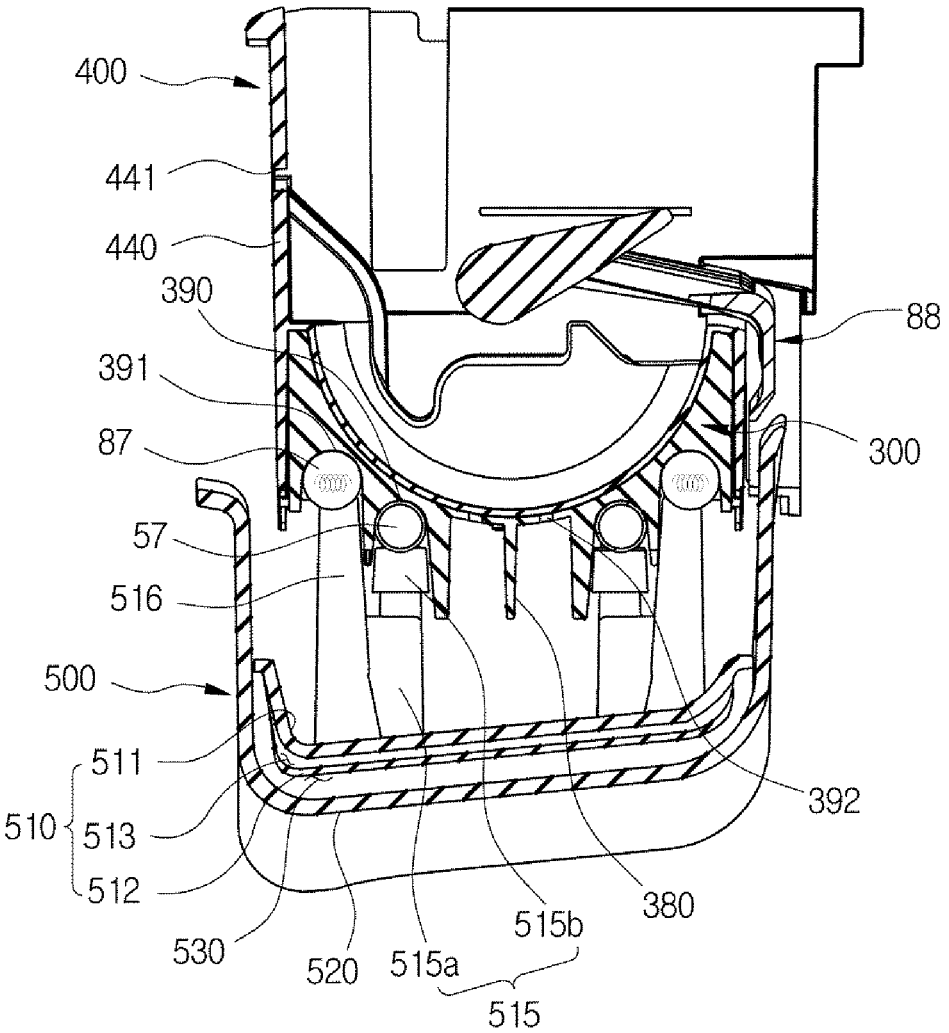
FIG. 6 is a cross-sectional view illustrating a cross-section of the ice maker of FIG. 4.
Figure 7:
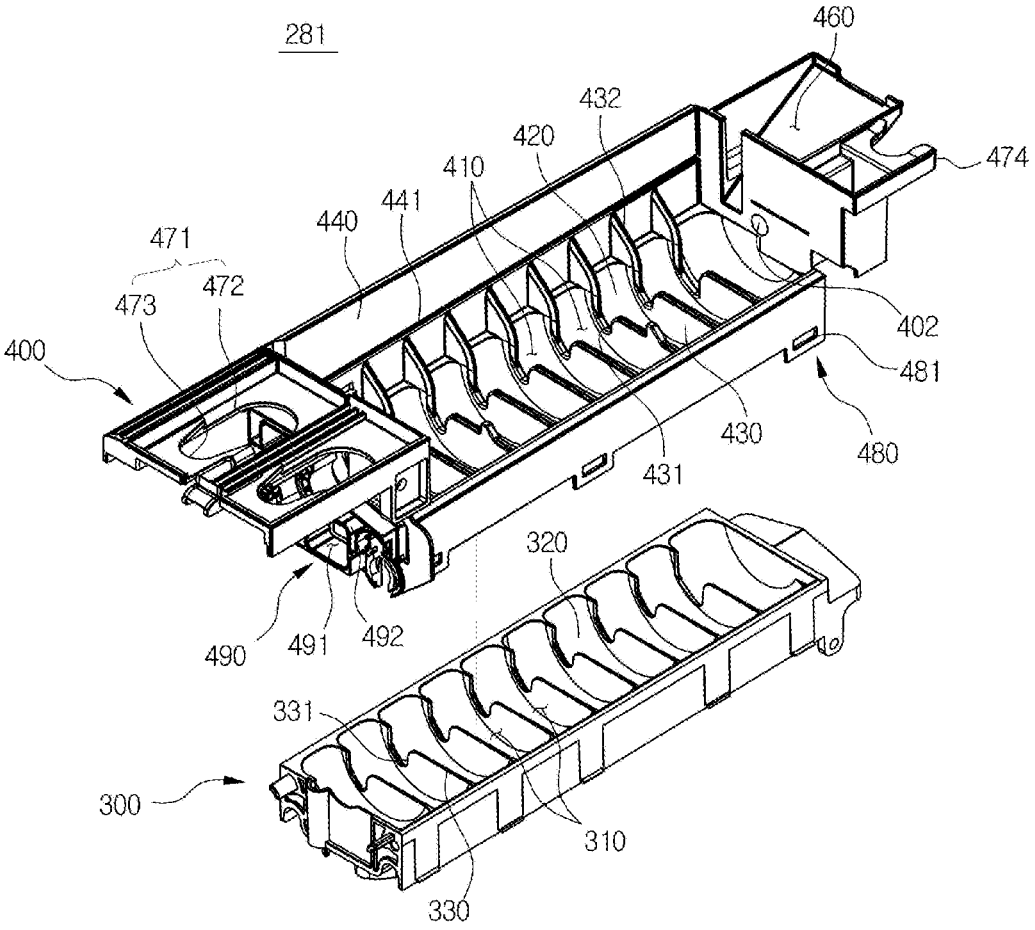
FIG. 7 and FIG. 8 are exploded top perspective views illustrating an ice-making tray of the ice maker of FIG. 4.
Figure 8:
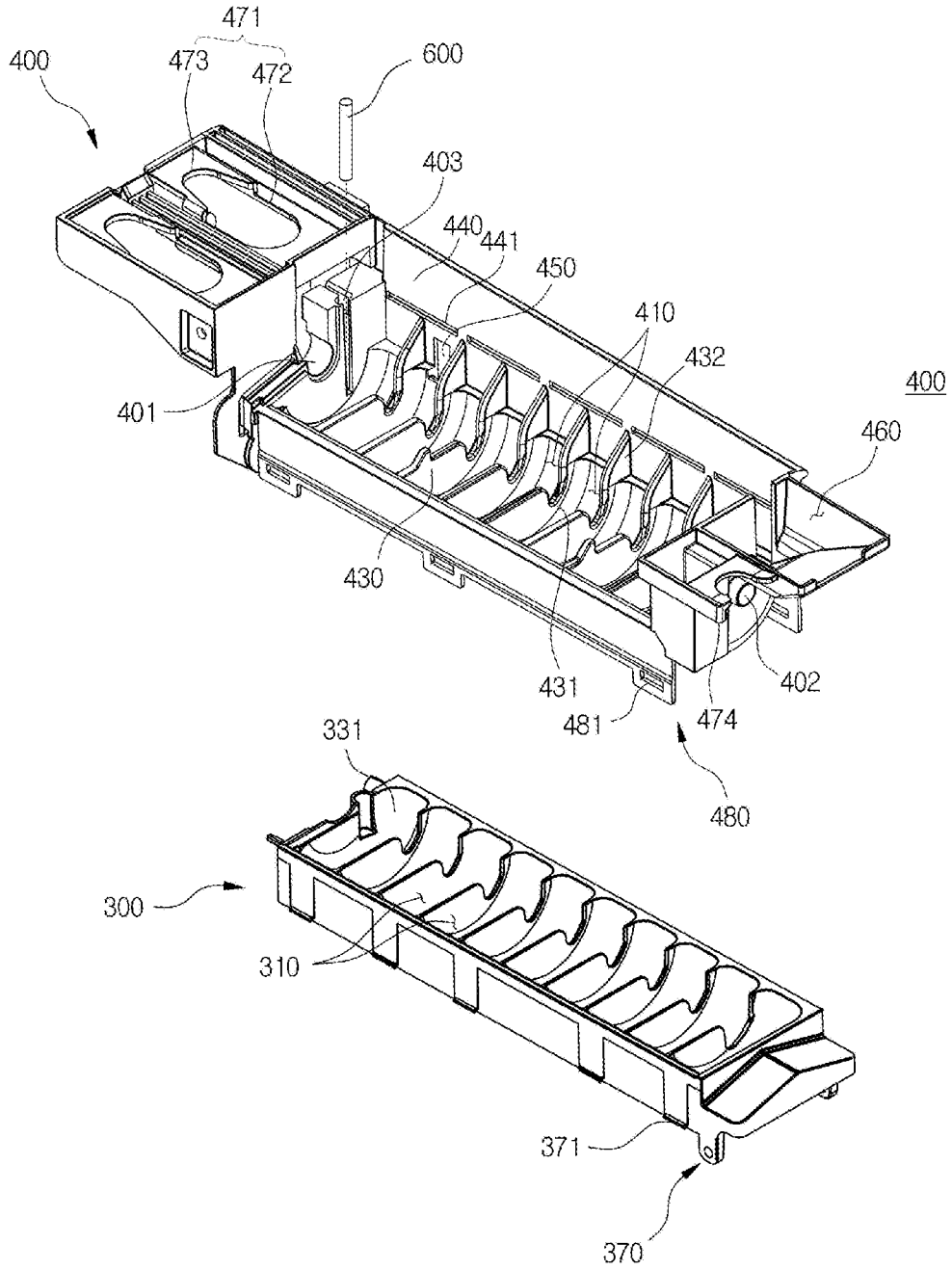
Figure 9:
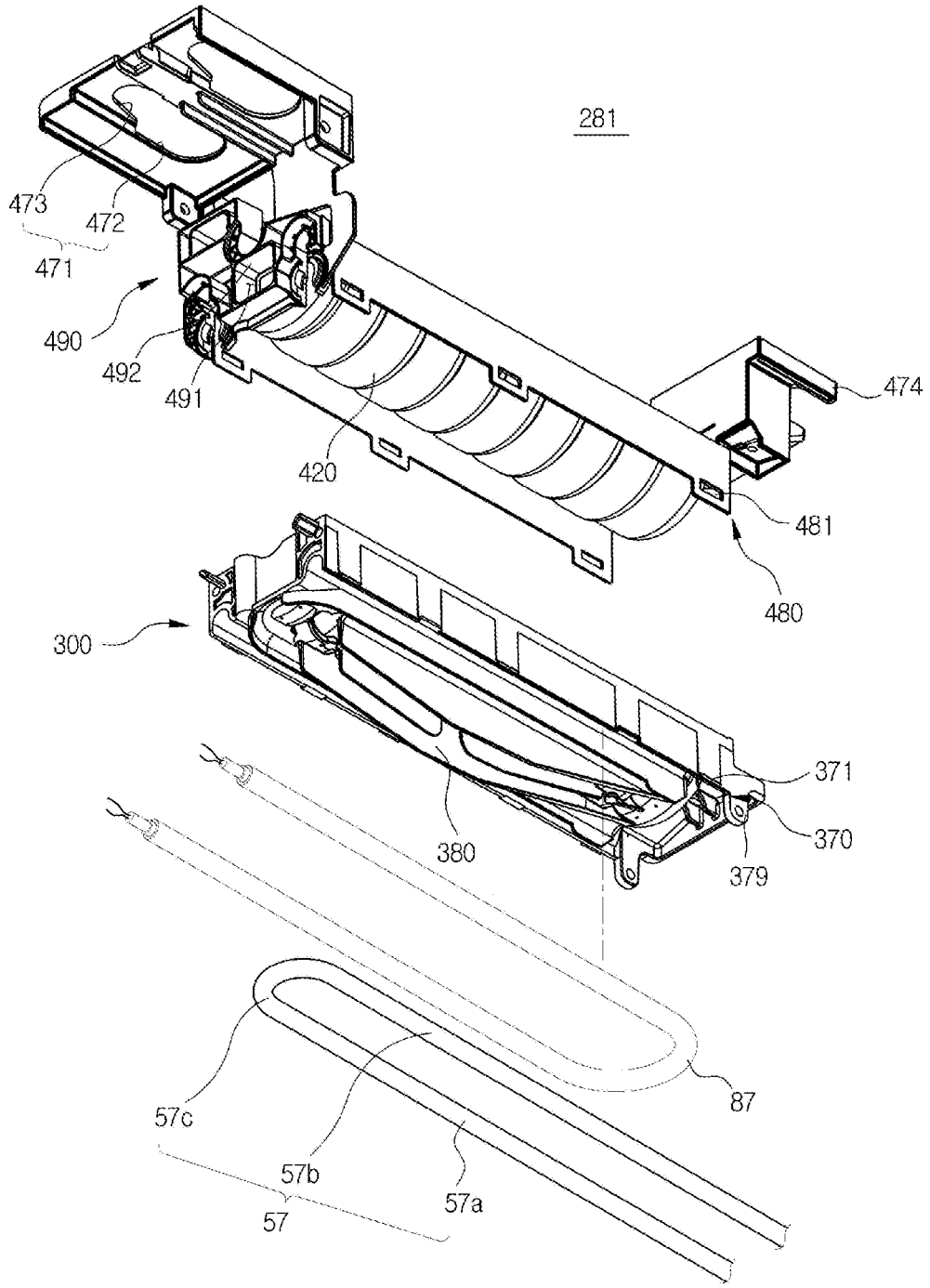
FIG. 9 is an exploded bottom perspective view illustrating the ice-making tray of the ice maker of FIG. 4.
Figure 10:
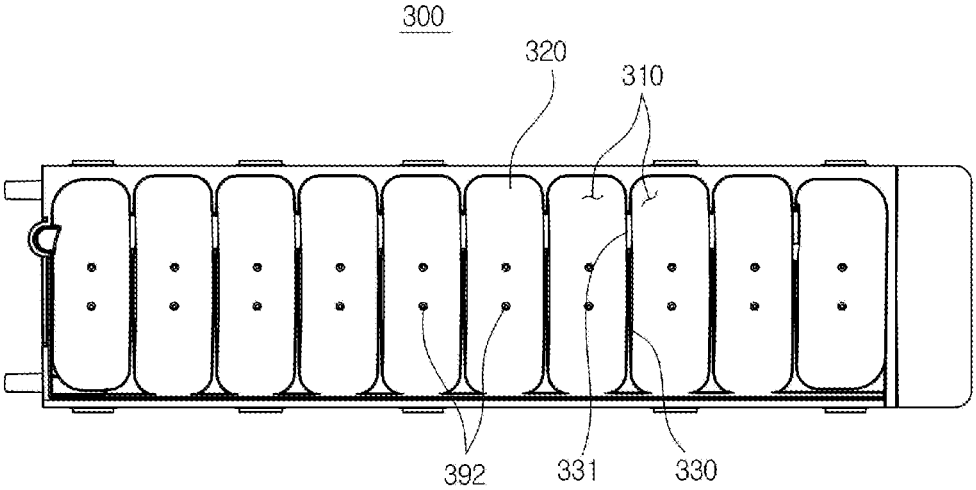
FIG. 10 is a view illustrating a top surface of a first tray of the ice maker of FIG. 4.
Figure 11:
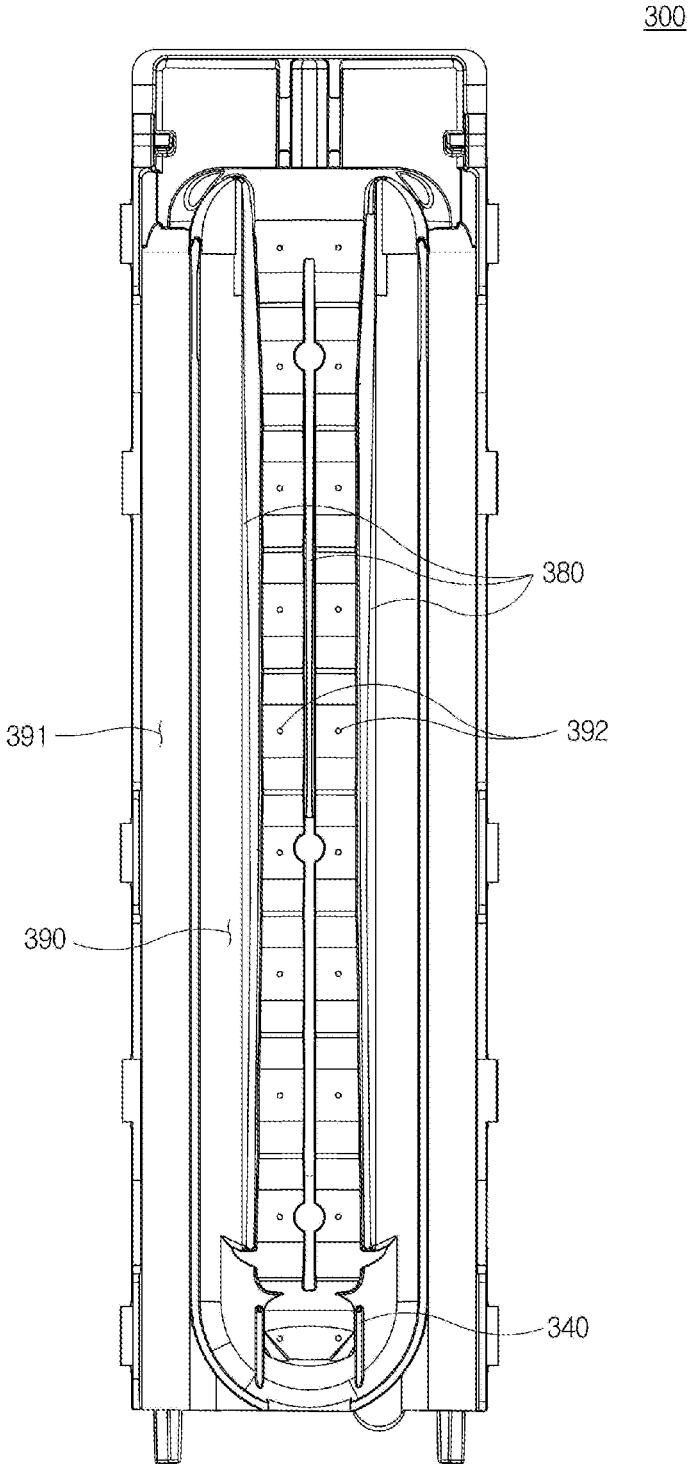
FIG. 11 is a view illustrating a bottom surface of the first tray of the ice maker of FIG. 4.

FIG. 4 is a perspective view illustrating an ice maker of the refrigerator of FIG. 1, FIG. 5 is an exploded perspective view illustrating the ice maker of FIG. 4, FIG. 6 is a cross-sectional view illustrating a cross-section of the ice maker of FIG. 4, FIGS. 7 and 8 are exploded top perspective views illustrating an ice-making tray of the ice maker of FIG. 4, FIG. 9 is an exploded bottom perspective view illustrating the ice-making tray of the ice maker of FIG. 4, FIG. 10 is a view illustrating a top surface of a first tray of the ice maker of FIG. 4, and FIG. 11 is a view illustrating a bottom surface of the first tray of the ice maker of FIG. 4.

Referring to FIGS. 1 to 11, the ice-making tray 281 includes the first tray 300 that is in contact with the ice-making chamber refrigerant pipe 57, receives cooling energy from the ice-making chamber refrigerant pipe 57 by thermal conduction, and is positioned at a lower portion thereof, and a second tray 400 that is coupled to overlap a top surface of the first tray 300 to receive the cooling energy from the first tray 300, and includes an ice-making cell 410 that stores ice-making water.

Since the first tray 300 is provided under the second tray 400, the first tray 300 may be referred as a lower tray, and the second tray 400 may be referred as an upper tray.

In the above-described structure, cooling energy is sequentially transferred from the ice-making chamber refrigerant pipe 57 through the first tray 300 to the second tray 400, ice-making water stored in the ice-making cell 410 of the second tray 400 may be cooled, and ice may be generated.

The first tray 300 may include ice-making cell accommodation portions 310 concavely formed to accommodate the ice-making cell 410 of the second tray 400, and a first base portion 320 forming the ice-making cell accommodation portion 310.

The ice-making cell accommodation portion 310 of the first tray 300 may have a shape corresponding to the ice-making cell 410 to accommodate the ice-making cell 410 of the second tray 400. The number of ice-making cell accommodation portions 310 may be equal to that of the ice-making cells 410. The ice-making cell accommodation portions 310 may be partitioned from each other by first partition portions 330. First communication portions 331 that enable ice-making cells 410 to communicate with each other may be provided at the first partition portions 330. Ice-making water may be sequentially supplied to the ice-making cells 410 through the first communication portions 331.

A heat exchanging rib 380 which expands an area which transfers heat to air inside the ice-making chamber 60, and facilitates heat exchange of internal air between the first tray 300 and the ice-making chamber 60 may protrude.

A refrigerant pipe accommodation portion 390 which accommodates the ice-making chamber refrigerant pipe 57, and an ice-ejecting heater accommodation portion 391 which accommodates the ice-ejecting heater 87 may be formed at an outside of a lower portion of the first tray 300. Each of the refrigerant pipe accommodation portion 390 and the ice-ejecting heater accommodation portion 391 may have a concave shape. The refrigerant pipe accommodation portion 390 and the ice-ejecting heater accommodation portion 391 may be formed between the heat exchanging ribs 380.

Each of the ice-making chamber refrigerant pipe 57 and the ice-ejecting heater 87 may be provided in a roughly U shape, and the refrigerant pipe accommodation portion 390 and the ice-ejecting heater accommodation portion 391 of the first tray 300 may also have a roughly U shape to correspond thereto. The refrigerant pipe accommodation portion 390 may be provided inside the ice-ejecting heater accommodation portion 391. As illustrated in FIG. 9, the ice-making chamber refrigerant pipe 57 may include a first refrigerant pipe portion 57*a* that extends in a length direction of the ice-making tray 281, a second refrigerant pipe portion 57*b* disposed in parallel to the first refrigerant pipe portion 57*a*, and a third refrigerant pipe portion 57*c* that connects the first refrigerant pipe portion 57*a* and the second refrigerant pipe portion 57*b*, and has a U shape.

The ice-making chamber refrigerant pipe 57 may be accommodated in the refrigerant pipe accommodation portion 390 to be in contact with the first tray 300, and the ice-ejecting heater 87 may be accommodated in the ice-ejecting heater accommodation portion 391 to be in contact with the first tray 300.

The first tray 300 may be formed of a material having high thermal conductivity to accelerate thermal conduction of cooling energy. For example, the first tray 300 may be formed of an aluminum material. The first tray 300 may be integrally formed.

A drain orifice 392 that drains defrosted water of frost frosted between the first tray 300 and the second tray 400 may be formed at the first tray 300. The drain orifice 392 may be formed at each of the ice-making cell accommodation portions 310 of the first tray 300.

The drain orifice 392 may decrease a heat transfer area of the first tray 300 and the second tray 400, and may serve a function that decreases an ice-making speed.

Figure 12:
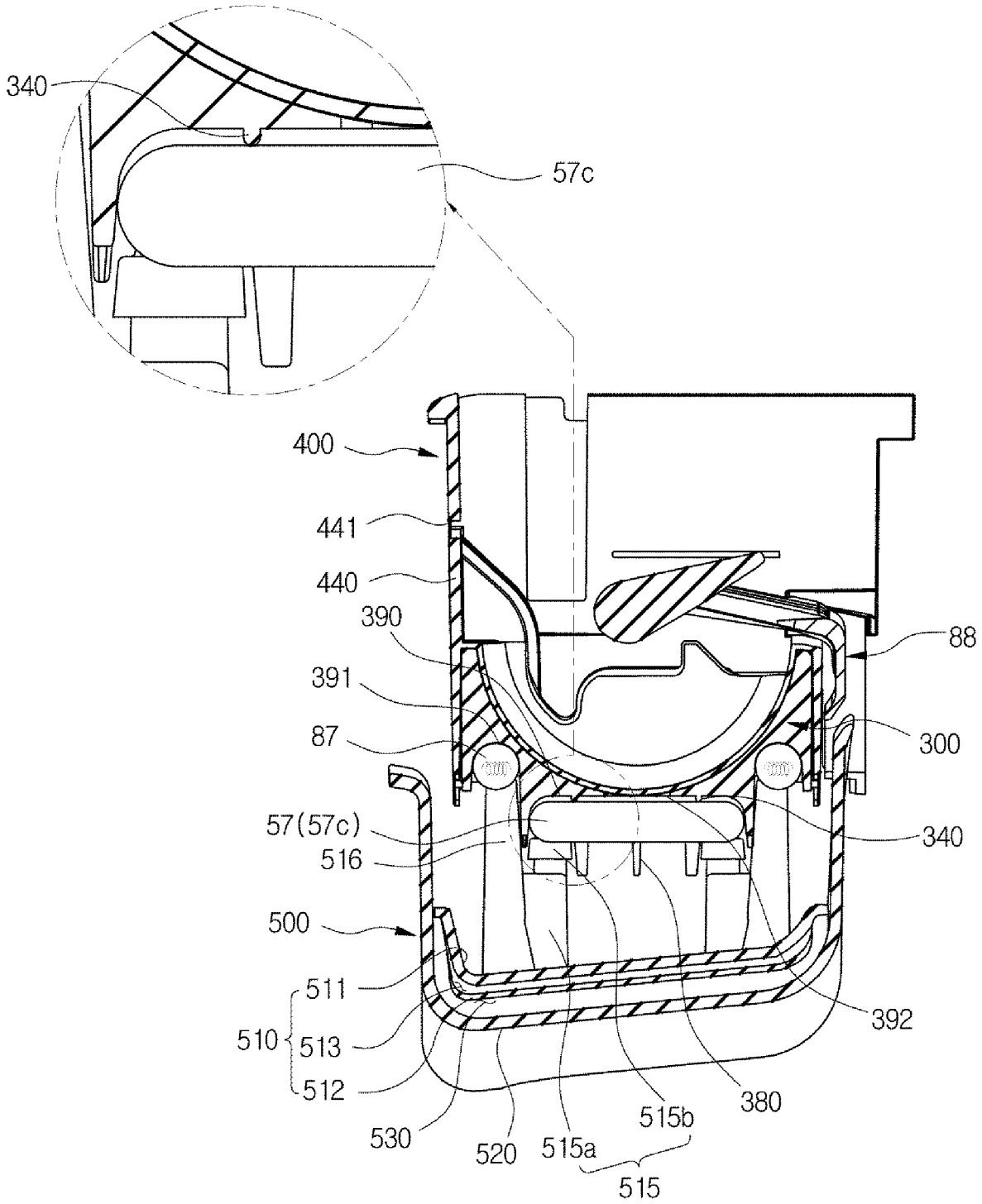
FIG. 12 is a view illustrating a cross-section of a part in which a protrusion formed at the bottom surface of the first tray in the ice maker of FIG. 4 is installed.

FIG. 12 is a view illustrating a cross-section of a part in which a protrusion formed at the bottom surface of the first tray in the ice maker of FIG. 4 is installed.

Referring to FIGS. 2 to 12, according to one embodiment, the first tray 300 may further include a protrusion 340 which separates a bottom surface of the first tray 300 and the ice-making chamber refrigerant pipe 57. The protrusion 340 may be formed at the bottom surface of the first tray 300, and may decrease a contact area between the ice-making chamber refrigerant pipe 57 and the first tray 300.

The protrusion 340 may be formed at a bottom surface of the ice-making tray 281 so that the third refrigerant pipe portion 57*c* is separated from the ice-making tray 281. The protrusion 340 may be formed at a region of the bottom surface of the first tray 300 which faces the third refrigerant pipe portion 57*c*. The protrusion 340 may be installed at the refrigerant pipe accommodation portion 390 in a plural number at predetermined gaps.

Since a contact area between the third refrigerant pipe portion 57*c* and the bottom surface of the first tray 300 is greater than a contact area between the first refrigerant pipe portion 57*a* and the second refrigerant pipe portion 57*b*, the ice-making chamber refrigerant pipe 57 may be excessively cooled. Accordingly, in the above-described structure, the contact area between the third refrigerant pipe portion 57*c* and the bottom surface of the first tray 300 may decrease, and cooling energy received from the ice-making chamber refrigerant pipe 57 may be uniformly controlled in the first tray 300.

The first tray 300 may be formed of a material having high thermal conductivity to accelerate thermal conduction of cooling energy. For example, the first tray 300 may be formed of an aluminum material. The first tray 300 may be integrally formed.

The second tray 400 may be coupled to be in close contact with the top surface of the first tray 300. As the second tray 400 is simply put on the top surface of the first tray 300, the second tray 400 may be coupled to the first tray 300.

However, a first coupling portion 370 may be provided at the first tray 300 and a second coupling portion 480 may be provided at the second tray 400 to increase a coupling force between the first tray 300 and the second tray 400.

The first coupling portion 370 and the second coupling portion 480 may be respectively provided at a side surface of the first tray 300 and a side surface of the second tray 400. The first coupling portion 370 and the second coupling portion 480 may be elastically coupled to each other. The first coupling portion 370 may include a coupling protrusion 371 (see FIG. 15) and the second coupling portion 480 may include a coupling groove 481 (see FIG. 15) coupled to the coupling protrusion 371.

The second tray 400 may include an ice-making cell 410 that stores ice-making water, a second base portion 420 forming the ice-making cell 410, second partition portions 430 that partition the ice-making cells 410 from each other, and second communication portions 431 that enable the ice-making cells 410 to communicate with each other to supply water to all of the ice-making cells 410 when the water is supplied.

When the ice-making speed of ice-making water is excessively high, a gas such as oxygen or carbon dioxide and other impurities melted in the ice-making water are not discharged, and a turbidity phenomenon in which ice is turbid may occur.

In order to solve the above-described turbidity phenomenon, the second tray 400 of the ice-making tray 281 according to an embodiment of the present disclosure is formed of a material having low thermal conductivity. For example, the second tray 400 may be formed of a plastic material. As a result, as the speed of thermal conduction of cooling energy decreases, the cooling speed of ice-making water may decrease, and accordingly, transparency of ice may be improved.

However, materials of the first tray 300 and the second tray 400 are not respectively limited to an aluminum material and a plastic material, and as long as the second tray 400 is formed of a material that has a lower thermal conductivity than that of the first tray 300, it may be consistent with the scope of the present disclosure.

That is, materials of the first tray 300 and the second tray 400 may be properly selected as long as the first tray 300 positioned thereunder is formed with a comparatively high thermal conductivity and effectively serves as a heat exchanger that cools the ice-making chamber 60, the second tray 400 positioned thereabove decreases a speed of thermal conduction of cooling energy slightly, and thus ice whose transparency is improved is generated.

The second tray 400 may be integrally formed. Accordingly, since each of the first tray 300 and the second tray 400 are formed, and the second tray 400 is simply coupled to overlap the top surface of the first tray 300, the ice-making tray 281 may be easily assembled, and thus all objectives of maintaining cooling performance inside the ice-making chamber 60 and improving transparency of ice may be achieved.

In the above description, as the second tray 400 is formed of a material having a lower thermal conductivity than that of the first tray 300, a speed of thermal conduction of cooling energy and a speed of cooling ice-making water may be decreased; however, alternatively or additionally, as a heat transfer area of the ice-making chamber refrigerant pipe 57 and the first tray 300 is decreased, a speed of thermal conduction of cooling energy and a speed of cooling ice-making water may be decreased.

To this end, even though it is not illustrated, a heat-transfer-area-reducing orifice (not shown) that reduces a heat transfer area of the ice-making chamber refrigerant pipe 57 may be formed at a portion in contact with the ice-making chamber refrigerant pipe 57 of the first tray 300. That is, a heat-transfer-area-reducing orifice 170 may be formed at the refrigerant pipe accommodation portion 390 of the first tray 300.

With the above-described structure, the ice-making tray 281 may receive cooling energy from the ice-making chamber refrigerant pipe 57 by the direct cooling method, and may quickly generate ice, and ice having improved transparency may be obtained. In addition, the same cooling performance of the ice-making chamber 60 of the ice-making tray 281 as that of a conventional ice-making tray may be maintained.

The second tray 400 may be coupled to be in close contact with the top surface of the first tray 300. The second tray 400 may be simply put on the top surface of the first tray 300, and coupled to the first tray 300.

However, the first coupling portion 370 may be provided at the first tray 300 and the second coupling portion 480 may be provided at the second tray 400 to increase a coupling force between the first tray 300 and the second tray 400.

The first coupling portion 370 and the second coupling portion 480 may be respectively provided at a side surface of the first tray 300 and a side surface of the second tray 400. The first coupling portion 370 and the second coupling portion 480 may be elastically coupled to each other. The first coupling portion 370 may include the coupling protrusion 371 and the second coupling portion 480 may include the coupling groove 481 coupled to the coupling protrusion 371.

The second tray 400 may include an ice-making cell 410 that stores ice-making water, the second base portion 420 forming the ice-making cell 410, second partition portions 430 that partition the ice-making cells 410 from each other, and second communication portions 431 that enable the ice-making cells 410 to communicate with each other to supply water to all of the ice-making cells 410 when the water is supplied.

The second tray 400 may include a separation preventing wall 440 that extends upward from one end of a widthwise side of the second base portion 420 to guide movement of ice when the ice is separated from the ice-making cell 410. When the ejector 84 rotates and lifts ice of the ice-making cell 410, the separation preventing wall 440 may prevent the ice from falling to the other side opposite to one side in which a slider 88 is provided. A slit 441 which prevents heat from vertically transferring through the separation preventing wall 440 may be formed at the separation preventing wall 440. The slit 441 may be formed long in a horizontal direction at the separation preventing wall 440.

The second tray 400 may include cutting ribs 432 that cut links between ice pieces generated at the ice-making cells 410 when the ice pieces are separated from the ice-making cell 410.

The second tray 400 may include a water supplying orifice 460 provided at a lengthwise end thereof to supply water to the ice-making cell 410. As the second tray 400 is provided to be inclined, water introduced from the water supplying orifice 460 may be sequentially supplied from the ice-making cell 410 most adjacent to the water supplying orifice 460 to the ice-making cell 410 farthest therefrom.

The second tray 400 may include an excessively supplied water discharge orifice 450 that discharges excessively supplied water through the drain duct 500 when the ice-making cell 410 is supplied with water more than a predetermined amount of water. The excessively supplied water discharge orifice 450 may be formed at one position of the separation preventing wall 440.

The second tray 400 may include a structure which supports the ejector 84, which separates ice generated at the ice-making cell 410. The second tray 400 may include rotating shaft accommodation portions 401 and 402 that rotatably accommodate a rotating shaft 85 of the ejector 84. The rotating shaft accommodation portions 401 and 402 may be respectively formed at a front end and a rear end of the second tray 400 in a lengthwise direction.

Figure 13:
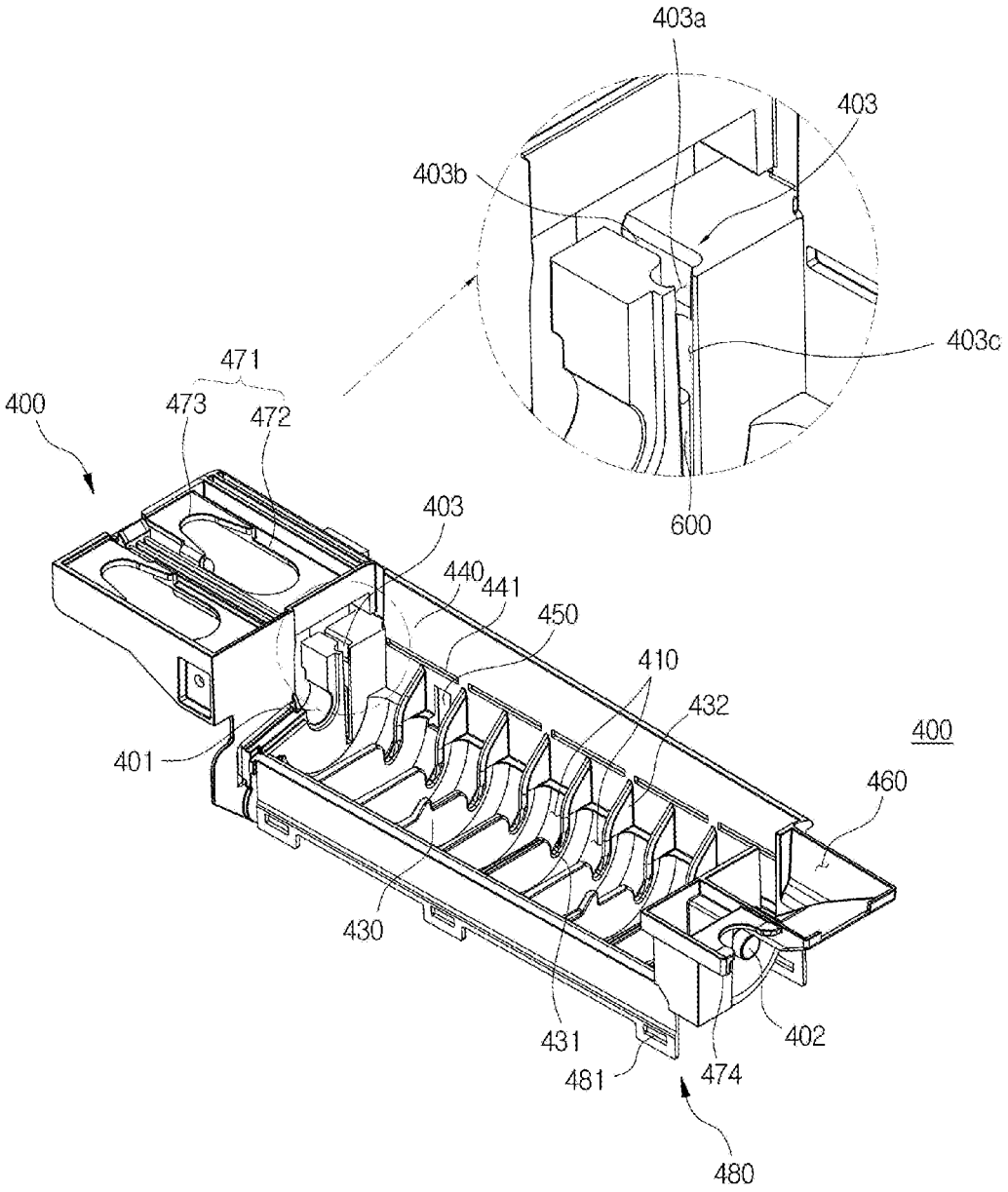
FIG. 13 is an enlarged view illustrating a temperature sensor accommodation portion formed at a second tray of the ice maker of FIG. 4.
Figure 14:
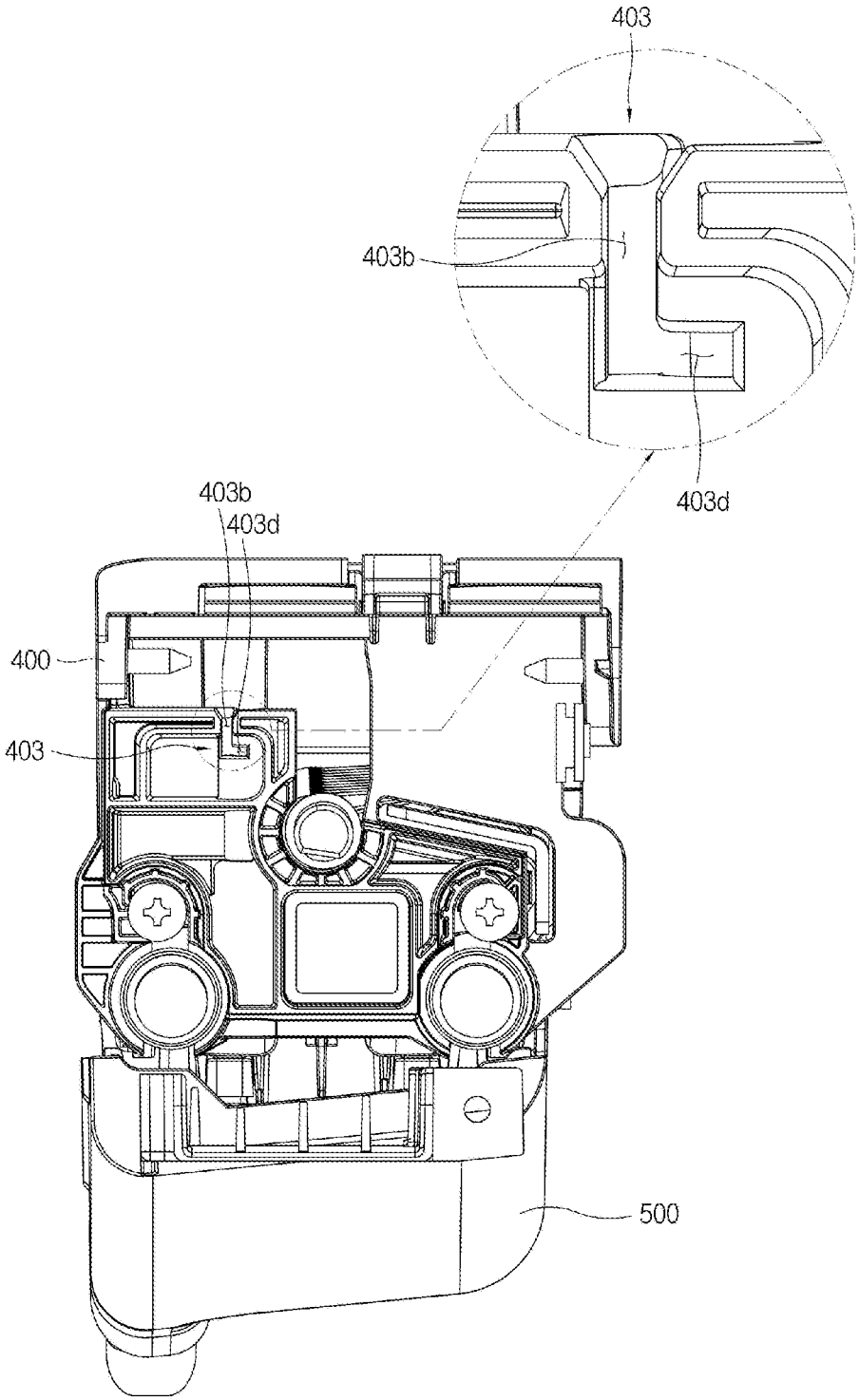
FIG. 14 is an enlarged view illustrating the temperature sensor accommodation portion of the ice maker of FIG. 4 seen from the side.
Figure 15:
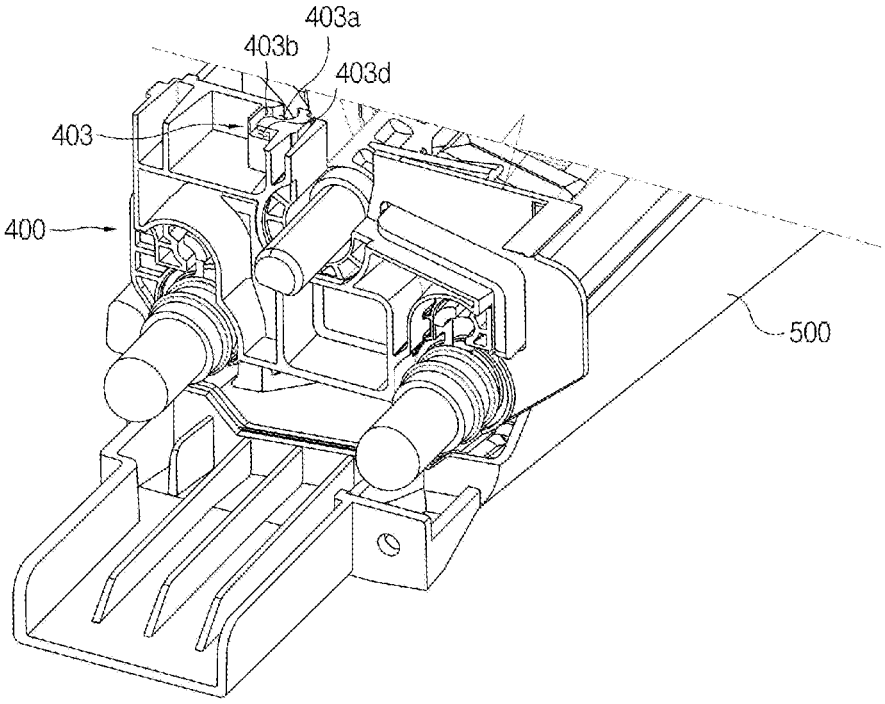
FIG. 15 is a view illustrating a cross-section of the temperature sensor accommodation portion formed at the second tray of the ice maker of FIG. 4.

FIG. 13 is an enlarged view illustrating a temperature sensor accommodation portion formed at a second tray of the ice maker of FIG. 4, FIG. 14 is an enlarged view illustrating the temperature sensor accommodation portion of the ice maker of FIG. 4 seen from the side, and FIG. 15 is a view illustrating a cross-section of the temperature sensor accommodation portion formed at the second tray of the ice maker of FIG. 4.

Referring to FIGS. 2 to 15, the second tray 400 may include a temperature sensor accommodation portion 403 which accommodates a temperature sensor 600 which measures temperature of water or ice accommodated in the ice-making cell 410. The temperature sensor accommodation portion 403 may be formed at one lengthwise end of the second tray 400, and accordingly, the temperature sensor 600 may measure temperature of water or ice accommodated in the ice-making cell 410 most adjacent to the lengthwise end of the second tray 400.

According to one embodiment, the temperature sensor accommodation portion 403 may include an accommodation portion 403*a* and a fixing portion 403*d*. The accommodation portion 403*a* may be formed in a groove shape of which an upper side is open through which the temperature sensor 600 moves in or out. The temperature sensor 600 may move through the upper side of the accommodation portion 403*a* to a lower portion thereof, and may be installed at the second tray 400.

The temperature sensor accommodation portion 403 may further include an ice-making water contact portion 403*c*. The ice-making water contact portion 403*c* may be formed at one side of the accommodation portion 403*a*. The ice-making water contact portion 403*c* may be provided in a shape in which at least a part of a side thereof facing the ice-making cell 410 is opened. The temperature sensor 600 accommodated in the temperature sensor accommodation portion 403 may be in contact with ice-making water through the ice-making water contact portion 403*c*, and may measure a temperature thereof. Optionally, the ice-making water contact portion 403*c* may also be omitted.

The temperature sensor accommodation portion 403 may further include a connecting portion 403*b*. The connecting portion 403*b* may be formed at one side of the accommodation portion 403*a*. The connecting portion 403*b* may be formed to extend from one side of the accommodation portion 403*a* in a direction different from the ice-making water contact portion 403*c*. The connecting portion 403*b* may be formed to extend in a direction opposite to the ice-making water contact portion 403*c*. The connecting portion 403*b* may be provided as a path through which a wire (not shown) connected to the temperature sensor 600 extends toward an outside of the ice-making tray 281. The connecting portion 403*b* may be provided as a path through which a wire (not shown) connected to the temperature sensor 600 extends toward an outside of the second tray 400.

The fixing portion 403*d* may be provided to be coupled to a part of the temperature sensor 600 or the wire (not shown) connected to the temperature sensor 600, and may fix a position of the temperature sensor 600. The fixing portion 403*d* may be formed to be bent toward one side of the accommodation portion 403*a*. The fixing portion 403*d* may be provided so that the wire (not shown) connected to the temperature sensor 600 is fixed at a space which is formed to be bent toward one side of the accommodation portion 403*a*.

The fixing portion 403*d* may be formed to extend from the accommodation portion 403*a* along the connecting portion 403*b*. Accordingly, the wire (not shown) connected to the temperature sensor 600 may extend along the connecting portion 403*b* toward the outside of the second tray 400 while coupled to the fixing portion 403*d*.

According to the above-described structure, in a state in which the temperature sensor 600 is accommodated in the temperature sensor accommodation portion 403, the wire (not shown) connected to the temperature sensor 600 may be coupled to the fixing portion 403*d*, and the temperature sensor 600 may be fixed.

The position of the temperature sensor 600 may be vertically changed according to the accommodation portion 403*a* while ice-making water is introduced to the ice-making cell 410 or is discharged therefrom. In addition, the position of the temperature sensor 600 may be vertically changed with ice-making water according to the accommodation portion 403*a* while ice-making water is being frozen. In this case, since the temperature sensor 600 may not measure temperature at the same position, a correct temperature may not be measured. In addition, when the measured temperature is not correct, a reliability of a freezing system may be lowered such as excessive freezing and the like. According to the above-described structure, temperature of ice-making water may be measured under the same condition, and thus reliability of a freezing system of the refrigerator may be improved.

Figure 16:
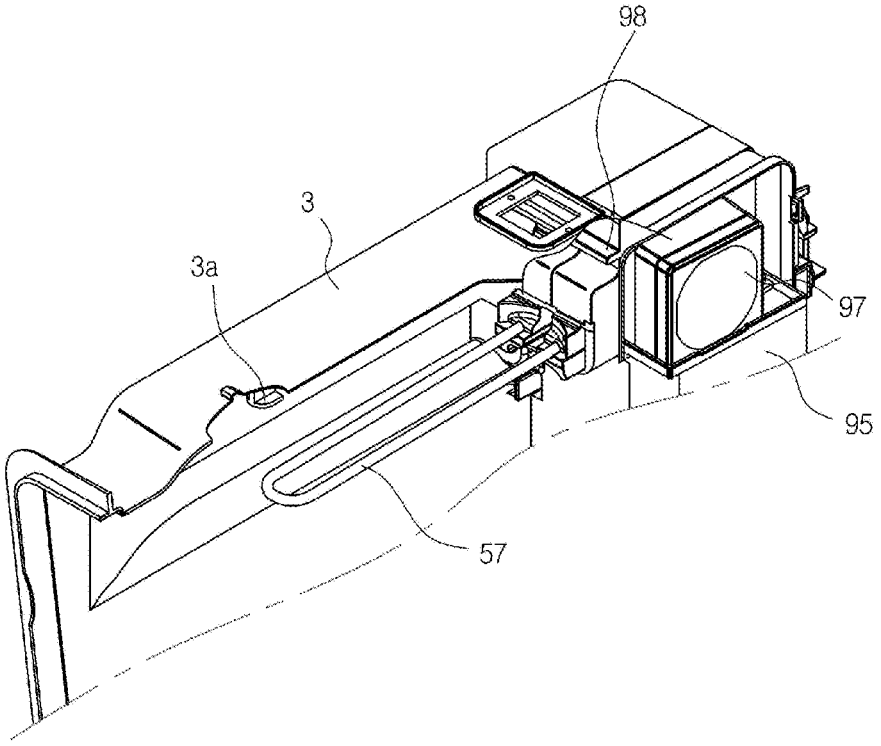
FIG. 16 is a view for describing a structure of an ice-making chamber for coupling the ice-making tray of FIG. 4 to the ice-making chamber.
Figure 17:
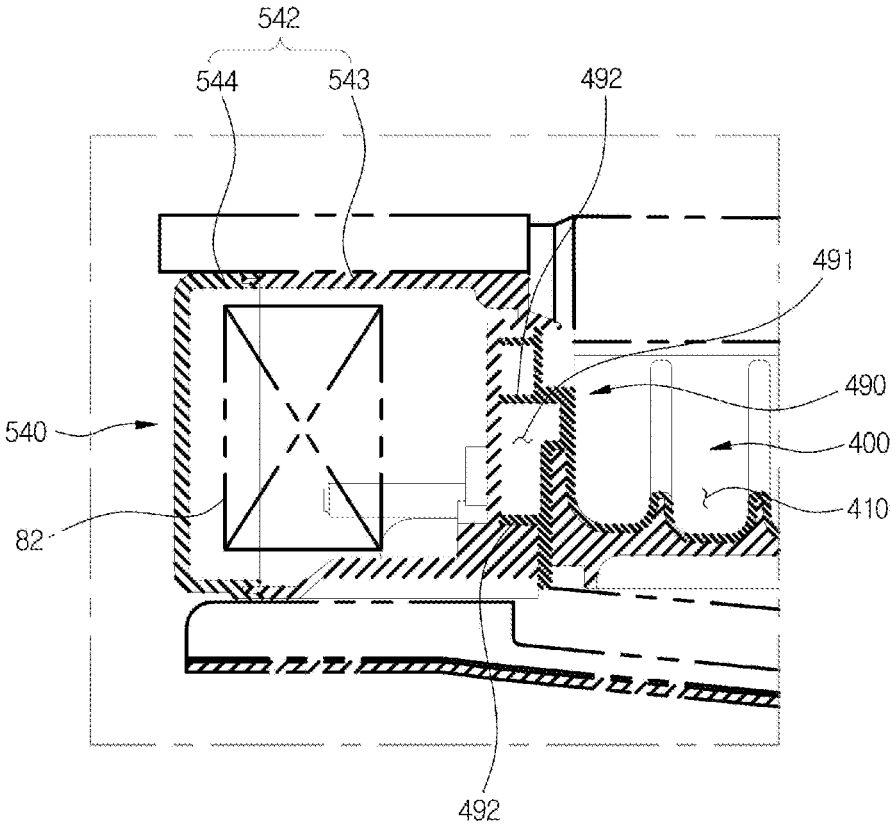
FIG. 17 is a cross-sectional view for describing an air insulating portion of the ice-making tray of FIG. 4.

FIG. 16 is a view for describing a structure of an ice-making chamber for coupling the ice-making tray of FIG. 4 to the ice-making chamber, and FIG. 17 is a cross-sectional view for describing an air insulating portion of the ice-making tray of FIG. 4.

Referring to FIGS. 2 to 17, the second tray 400 may include an air insulating portion 490 which insulates the ice-making tray 281 from an ice-ejecting motor 82. Since the air insulating portion 490 insulates the ice-making tray 281 from the ice-ejecting motor 82, malfunction of the ice-ejecting motor 82 and unnecessary heat loss may be prevented.

The air insulating portion 490 may include an air wall portion 492 that protrudes from a lengthwise front end of the second tray 400, and an air accommodation portion 491 formed inside the air wall portion 492. A side of the air wall portion 492 may be formed in a closed loop shape, and a front side of the air wall portion 492 may be open. The open front side of the air wall portion 492 may be closed by an ice-ejecting motor case 542 which accommodates the ice-ejecting motor 82. Accordingly, an inside of the air accommodation portion 491 may be a closed space. As the air accommodation portion 491 is filled with air, the air accommodation portion 491 may insulate the ice-making tray 281 from the ice-ejecting motor 82.

The ice-ejecting motor case 542 may be formed by coupling a front case 544 and a rear case 543, and the air wall portion 492 may be provided to be in close contact with the rear case 543. An ice-ejecting motor portion 540 may include the ice-ejecting motor 82 and the ice-ejecting motor case 542.

The second tray 400 may include a fixing portion which fixes the ice-making tray 281 inside the ice-making chamber 60. That is, the ice-making tray 281 may be directly fixed inside the ice-making chamber 60 without an additional fixing member.

The fixing portion may couple the second tray 400 to a ceiling of the inner box 3 of the ice-making chamber 60. To this end, the fixing portion may include a groove portion 471 coupled to a hook portion 3*a* provided at the ceiling of the inner box 3 of the ice-making chamber 60.

The groove portion 471 may include a large diameter portion 472 that is comparatively large, and a small diameter portion 473 that is comparatively small. The large diameter portion 472 may have a size through which the hook portion 3*a* may enter, and the small diameter portion 473 may have a size through which the hook portion 3*a*, which passed through the large diameter portion 472, may not move out.

When the ice-making tray 281 is inserted into the ice-making chamber 60, the hook portion 3*a* may be inserted into the large diameter portion 472 of the second tray 400, and may move toward the small diameter portion 473. Since the hook portion 3*a* that moves toward the small diameter portion 473 is not separated from the small diameter portion 473, the ice-making tray 281 may be fixed to the ice-making chamber 60.

The fixing portion may include a mounting portion 474 in which the second tray 400 is put on a supporting portion 98 provided at the ice-making chamber 60 and is supported thereby. The supporting portion 98 may also be integrally formed with the inner box 3 of the ice-making chamber 60, and may also be formed in a separate structure provided inside the ice-making chamber 60.

The above-described fixing portion may be formed at a front outside or a rear outside of an upper portion of the ice-making cell 410 of the second tray 400. That is, the upper portion of the ice-making cell 410 of the second tray 400 may be open. The reason is that injection molding of the second tray 400 in which the fixing portion is integrally formed is performed easily. When the fixing portion is not positioned at the outside of the upper portion of the ice-making cell 410 of the second tray 400 but is positioned at a direct upper portion thereof, it may not be easy to inject the second tray 400 using a general mold.

In the above-described structure, according to an embodiment of the present disclosure, an ice-making speed of the ice-making tray 281 is decreased and transparency of ice is improved. In addition, components of related parts of the ice-making tray 281 are integrally formed with the ice-making tray 281, the number of components is decreased, and thus performance of assembly and productivity may be improved.

The drain duct 500 may be provided under the ice-making tray 281 and collect defrosted water fallen from the ice-making tray 281 or the ice-making chamber refrigerant pipe 57. A path for cold air may be formed between the ice-making tray 281 and the drain duct 500.

The drain duct 500 may include a drain plate 510 that collects defrosted water, and a frost preventing cover 520 that surrounds a lower portion of the drain plate 510 to prevent freezing of the drain plate 510.

The drain plate 510 may be disposed to be inclined so that collected water flows toward a drain orifice.

The drain plate 510 may include a refrigerant pipe fixing portion 515 that presses the ice-making chamber refrigerant pipe 57 and presses and fixes the ice-making chamber refrigerant pipe 57 against and to the bottom surface of the first tray 300. The refrigerant pipe fixing portion 515 may include a protrusion 515*a* that protrudes upward from the drain plate 510, and an elastic portion 515*b* provided at an end portion of the protrusion 515*a*. The elastic portion 515*b* may be formed of a rubber material. Since the elastic portion 515*b* has an elastic force, the elastic portion 515*b* smoothly presses the ice-making chamber refrigerant pipe 57, and accordingly, prevents damage of the ice-making chamber refrigerant pipe 57 from impact. In addition, the elastic portion 515*b* may prevent cold air from being directly transferred from the ice-making chamber refrigerant pipe 57 to the drain plate 510, and may prevent frost from occurring at the drain plate 510.

The drain plate 510 may include an ice-ejecting heater contact portion 516 that is in contact with the ice-ejecting heater 87, fixes the ice-ejecting heater 87, and receives heat from the ice-ejecting heater 87. Since heat of the ice-ejecting heater 87 is transferred through the ice-ejecting heater contact portion 516 to the drain plate 510, frost is prevented from occurring at the drain plate 510, and, even when frost occurs, the frost may be easily defrosted.

According to one embodiment, the drain plate 510 may include a first drain plate 511 and an insulating plate 512. The first drain plate 511 may be disposed above the insulating plate 512, and may be provided to collect defrosted water that falls from the ice-making tray 281 or the ice-making chamber refrigerant pipe 57.

The insulating plate 512 may be coupled to the first drain plate 511 to form an insulating space 513. The insulating plate 512 may be formed of a material having thermal conductivity lower than that of the first drain plate 511.

The frost preventing cover 520 may be formed of a plastic material having a low thermal conductivity.

An air insulating layer 530 that insulates the drain plate 510 from the frost preventing cover 520 may be formed between the drain plate 510 and the frost preventing cover 520. That is, the drain plate 510 and the frost preventing cover 520 are provided to be spaced a predetermined gap from each other, and air may be filled therebetween.

Figure 18:
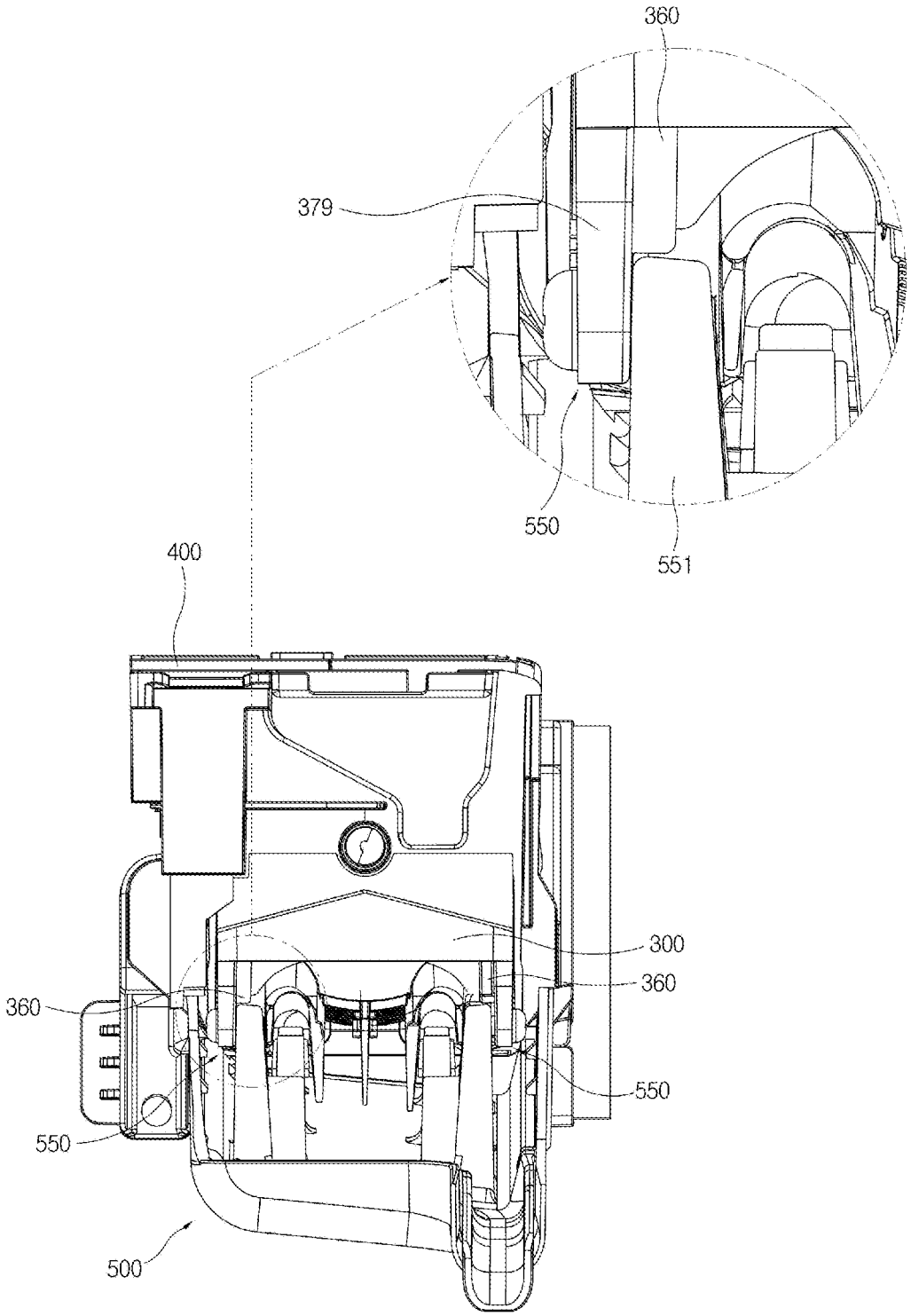
FIG. 18 is a view illustrating a state in which a drain duct and the ice-making tray are coupled to each other, seen from one side of the ice maker of FIG. 4.
Figure 19:
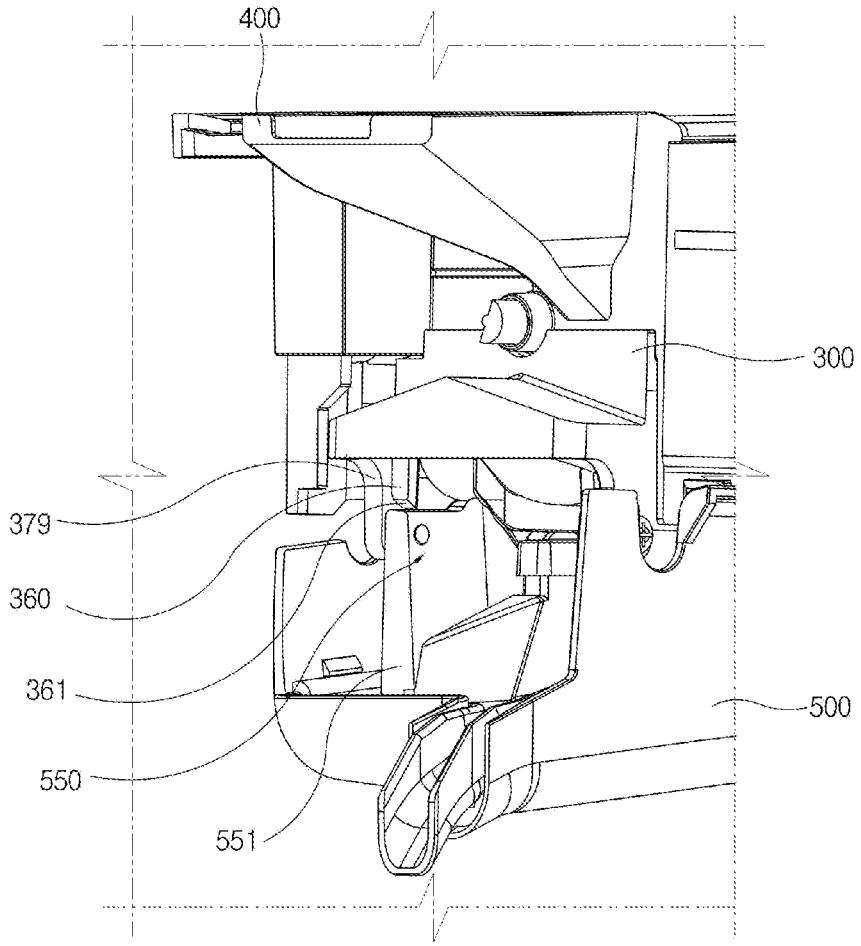
FIG. 19 and FIG. 20 are views illustrating an operation in which the drain duct of FIG. 18 rotates and opens at a predetermined angle.
Figure 20:
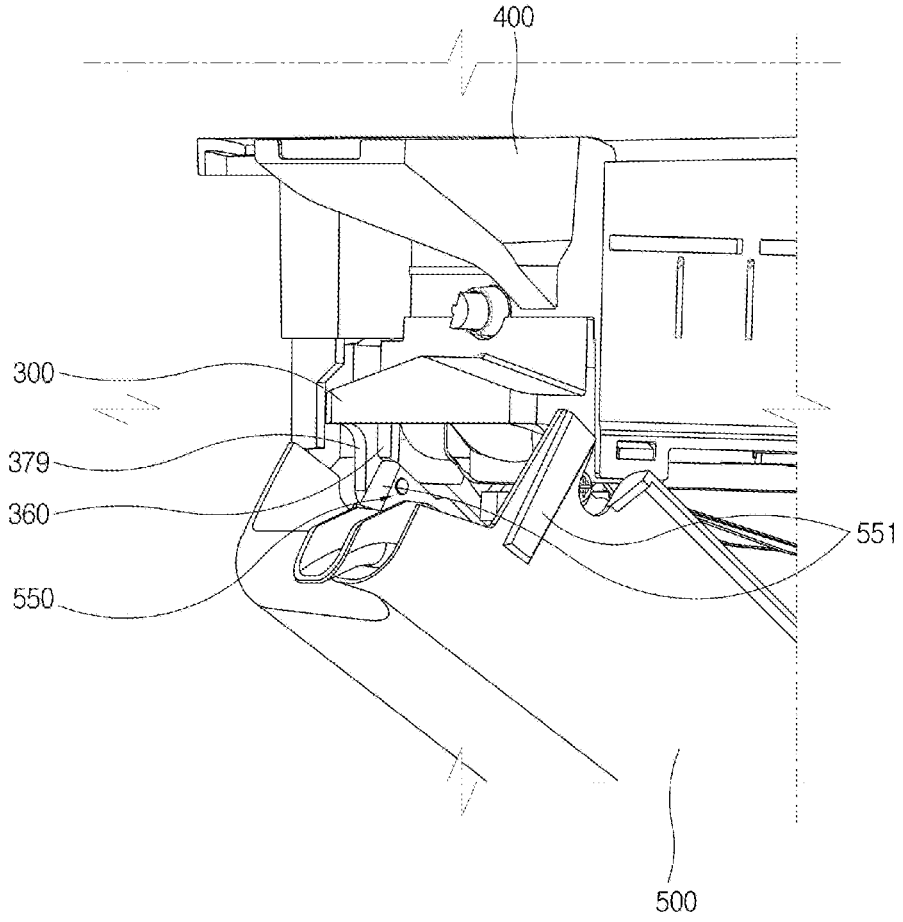

FIG. 18 is a view illustrating a state in which a drain duct and the ice-making tray are coupled to each other, seen from one side of the ice maker of FIG. 4, and FIGS. 19 and 20 are views illustrating an operation in which the drain duct of FIG. 18 rotates and opens at a predetermined angle.

Referring to FIGS. 18 to 20, the drain duct 500 may be coupled to the ice-making tray 281 to be opened while rotating around one side of the ice-making tray 281. A hinge-coupling portion 550 that is coupled to rotate around one side of the first tray 300 may be formed at the drain duct 500. A coupling portion 551 of the drain duct 500 and a coupling portion 379 of the first tray 300 may be hinge-coupled in the hinge-coupling portion 550.

According to one embodiment, the first tray 300 may further include a rotation limiting portion 360 that limits a range in which the drain duct 500 rotates. The rotation limiting portion 360 may be formed in a radius of rotation of the drain duct 500. Accordingly, the rotation limiting portion 360 may be provided so that the drain duct 500 rotates only in a predetermined range.

An inclined surface 361 may be formed at a bottom surface of the rotation limiting portion 360 to be in contact with a contact surface of the drain duct 500. Accordingly, destruction of the drain duct 500, which may occur when the coupling portion 551 of the drain duct 500 rotates and is in contact with the rotation limiting portion 360, may be prevented. The rotation limiting portion 360 may also be provided of an elastic material. The rotation limiting portion 360 may be formed at an inner side surface of the first tray 300. The rotation limiting portion 360 may be formed at an inner side surface of the coupling portion 379 to which the first tray 300 is hinge-coupled.

Since the ice-making chamber refrigerant pipe 57, the ice-ejecting heater 87, and the like are disposed between the drain duct 500 and the ice-making tray 281, the drain duct 500 is constituted to be openable. Accordingly, as described above, when the drain duct 500 is opened, since an angle thereof is limited, it does not need to control rotation of the drain duct 500, and thus user's convenience may be improved.

Figure 21:
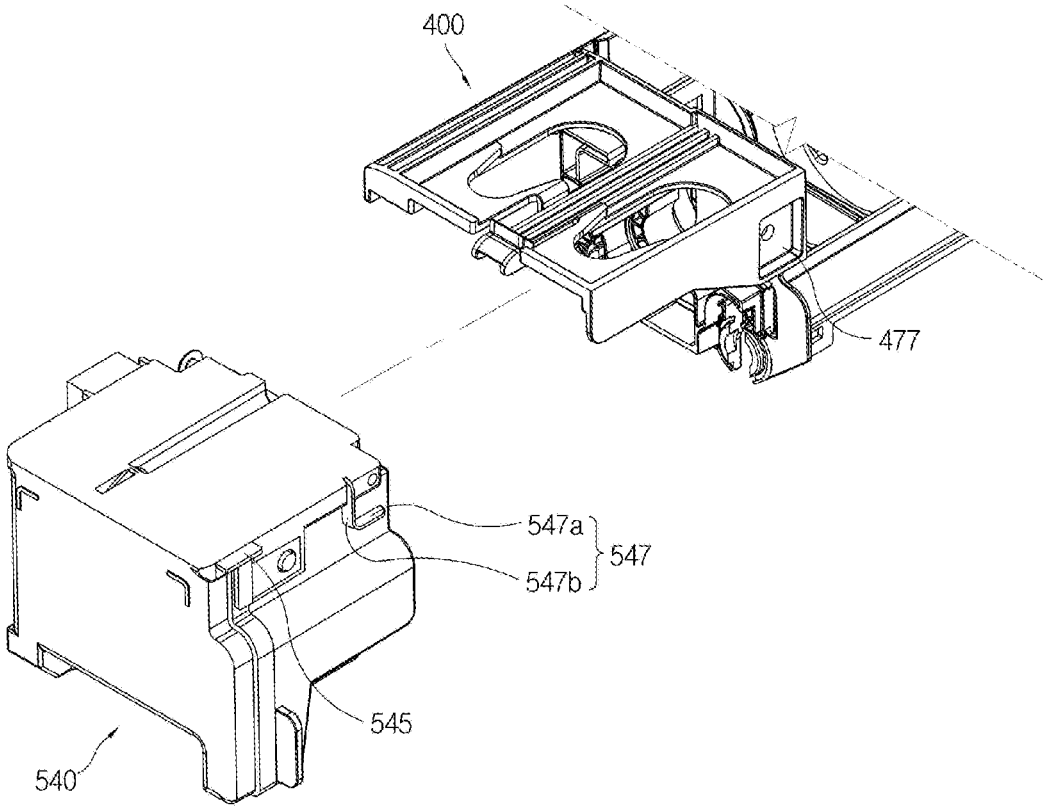
FIG. 21 is a view illustrating a coupling relation between an ice-ejecting motor portion and the ice-making tray in the ice maker of FIG. 4.
Figure 22:
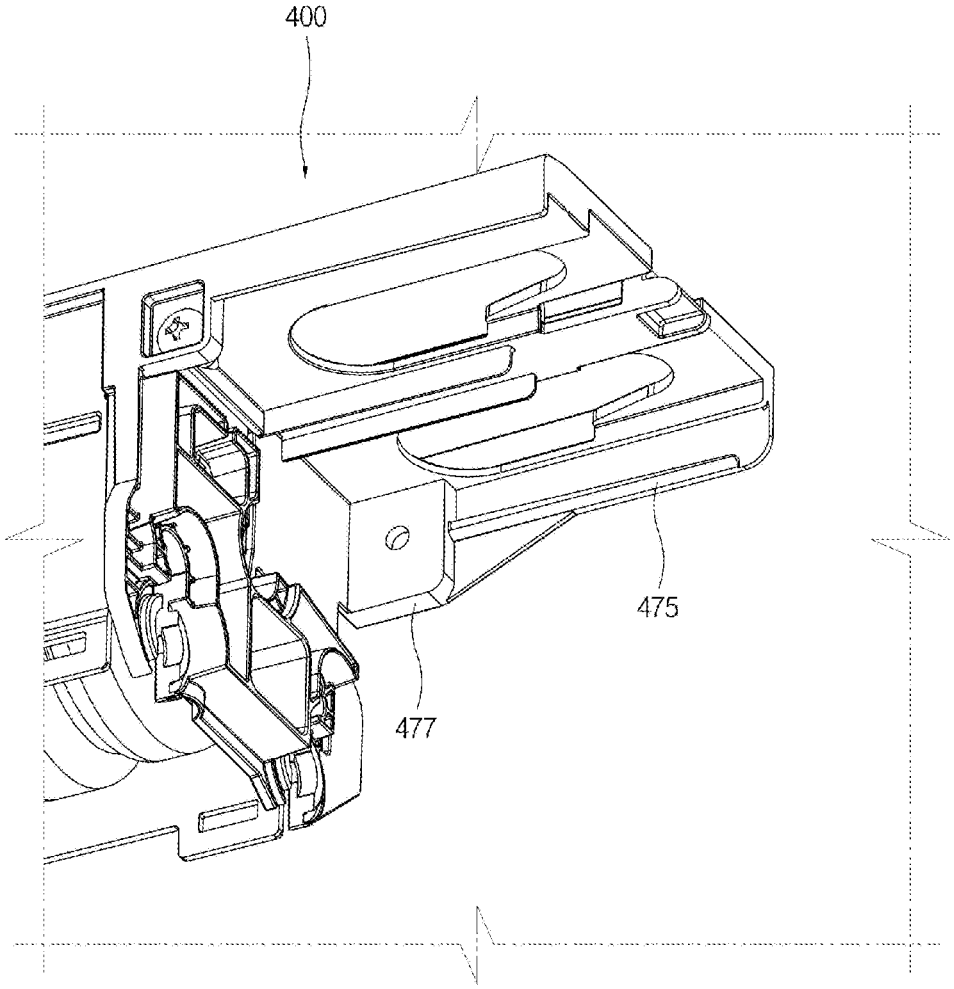
FIG. 22 is a view illustrating a supporting member formed at an inner side surface of the ice-making tray in the ice maker of FIG. 4.
Figure 23:
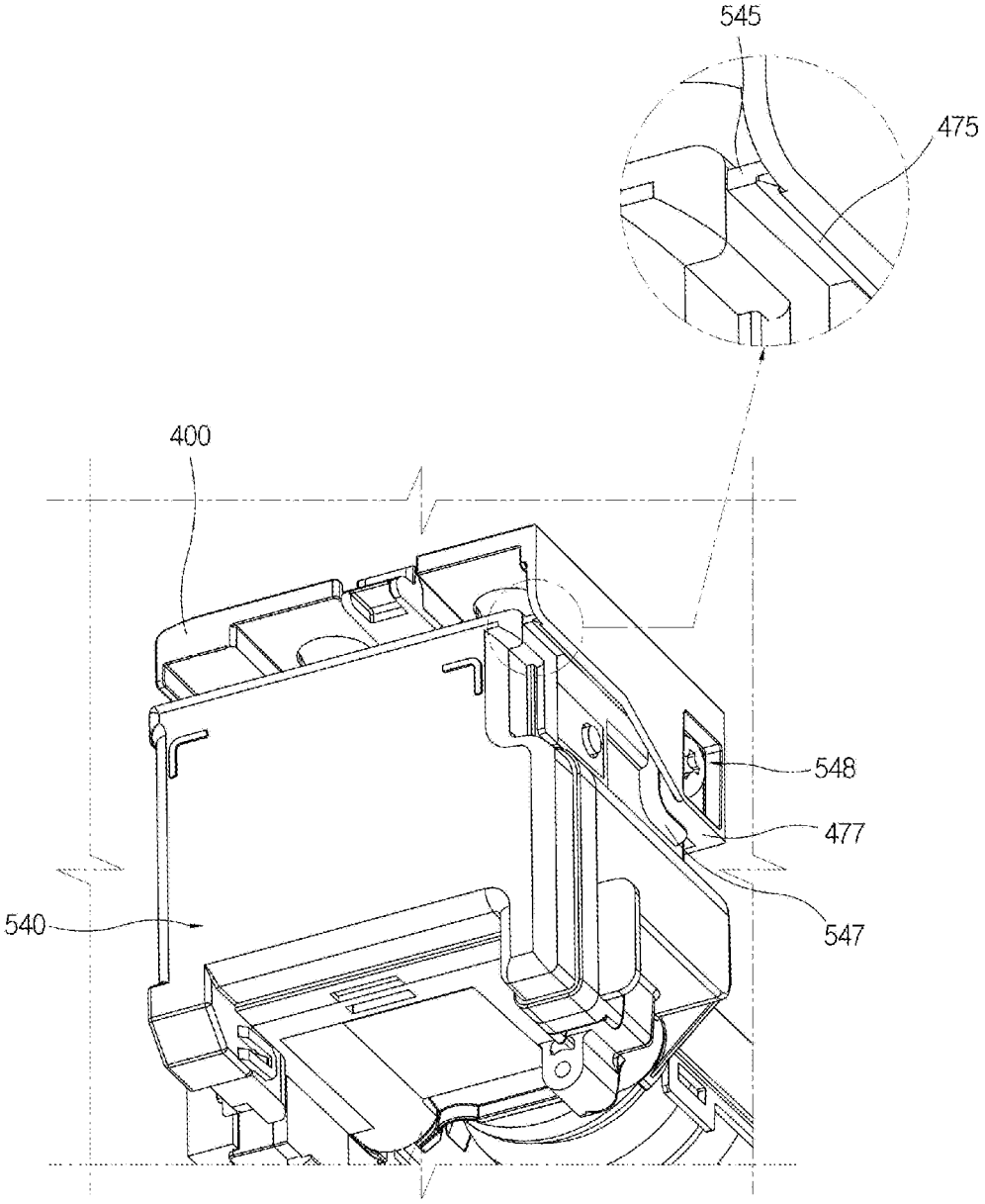
FIG. 23 is a view illustrating a state in which the ice-ejecting motor portion of FIG. 21 and the ice-making tray are coupled to each other.

FIG. 21 is a view illustrating a coupling relation between an ice-ejecting motor portion and the ice-making tray in the ice maker of FIG. 4, FIG. 22 is a view illustrating a supporting member formed at an inner side surface of the ice-making tray in the ice maker of FIG. 4, and FIG. 23 is a view illustrating a state in which the ice-ejecting motor portion of FIG. 21 and the ice-making tray are coupled to each other.

Referring to FIGS. 21 to 23, the ice-ejecting motor portion 540 inside which the ice-ejecting motor 82 is installed may be coupled to the ice-making tray 281. The ice-ejecting motor portion 540 may be coupled to one side of the second tray 400. The ice-ejecting motor portion 540 may include a screw-coupling portion 548 which is screw-coupled to one side of the second tray 400.

According to one embodiment, a locking step 545 that protrudes toward a side thereof may be formed at one side surface of the ice-ejecting motor portion 540. The locking step 545 may be formed to be spaced a predetermined gap from the screw-coupling portion 548. The locking step 545 and the screw-coupling portion 548 may be formed at the same plane, the locking step 545 may be disposed at one end thereof, and the screw-coupling portion 548 may be disposed at a position facing the locking step 545. A distance between the screw-coupling portion 548 and the ice-making cell 410 may be less than a distance between the locking step 545 and the ice-making cell 410. Alternatively, the distance between the screw-coupling portion 548 and the ice-making cell 410 may also be greater than the distance between the locking step 545 and the ice-making cell 410.

A supporting member 475 provided at a position corresponding to the locking step 545 to support the locking step 545 may be formed at the ice-making tray 281. The supporting member 475 may be formed at the position corresponding to the locking step 545 inside the second tray 400. In a state in which the ice-ejecting motor portion 540 is coupled to the ice-making tray 281, the supporting member 475 may be provided to support the locking step 545.

According to the above-described structure, the ice-ejecting motor portion 540 may be coupled so that a sagging phenomenon from the ice-making tray 281 does not occur.

In addition, the ice-ejecting motor portion 540 may include a seating guide 547. The seating guide 547 may be formed to support a part of a coupling surface 477 of the ice-making tray corresponding to the screw-coupling portion 548 of the ice-making tray 281. The seating guide 547 may include a first seating guide 547*a* that supports a bottom surface of the coupling surface 477 of the ice-making tray, and a second seating guide 547*b* that supports one side surface of the coupling surface 477 of the ice-making tray. In a state in which the ice-ejecting motor portion 540 is coupled to the ice-making tray 281, the seating guide 547 may be constituted to support the coupling surface 477 of the ice-making tray.

According to the above-described structure, the ice-ejecting motor portion 540 may be more stably coupled to the ice-making tray 281. In addition, since the ice-ejecting motor portion 540 is coupled to the ice-making tray 281 along the seating guide 547, a coupling convenience thereof may be improved.

As is apparent from the above description, a direct cooling ice-making tray according to an embodiment of the present disclosure can generate ice having improved transparency by decreasing a cooling speed of ice-making water slightly compared to a conventional direct cooling ice-making tray formed of only an aluminum material. In addition, the direct cooling ice-making tray according to an embodiment of the present disclosure can still have a cooling speed faster than that of an indirect cooling method.

An ice-making tray according to an embodiment of the present disclosure can be easily assembled using a method in which each of an aluminum tray and a plastic tray is integrally formed, and the plastic tray is simply disposed to overlap a top surface of the aluminum tray.

Since an aluminum tray having excellent thermal conductivity is disposed at a lower portion of a direct cooling ice-making tray according to an embodiment of the present disclosure, and a heat exchanging rib that expands an area that transfers heat to air inside an ice-making chamber is formed at the aluminum tray, the performance for cooling an inside of the ice-making chamber can be maintained the same as that of a conventional ice-making tray.

According to an embodiment of the present disclosure, since related parts of an ice-making tray are integrally unified to the ice-making tray, and the number of the parts is decreased, assembly performance and productivity can be improved.

According to an embodiment of the present disclosure, since a position of a temperature sensor coupled to an ice-making tray is fixed, the reliability of the temperature sensor can be improved.

According to an embodiment of the present disclosure, since a rotation range of a drain duct is limited to a predetermined range, parts such as a refrigerant pipe installed inside the drain duct can be easily assembled or disassembled.

According to an embodiment of the present disclosure, cooling energy can be uniformly transferred to an ice-making tray regardless of a shape of a refrigerant pipe.

According to an embodiment of the present disclosure, since an ice-ejecting motor portion and an ice-making tray are stably coupled to each other, sagging of the ice-ejecting motor portion can be prevented.

While the present disclosure has been described above in detail with reference to specific shapes, the present disclosure may be understood by those skilled in the art that the embodiment may be variously changed or modified without departing from the scope of the present disclosure.

What is claimed is:

1. A refrigerator comprising:

a main body;

an ice-making chamber formed inside the main body;

an ice-making tray installed inside the ice-making chamber and to store ice generated therein; and a refrigerant pipe installed to the ice-making tray so that at least a part thereof is in contact with the ice-making tray to cool the ice-making tray to generate the ice therein, wherein the refrigerant pipe includes a first portion and a second portion which are extended in a length direction of the ice making tray, the second portion being parallel to the first portion, and a U-shaped third portion to connect one end of the first portion and one end of the second portion, and wherein the ice-making tray includes a refrigerant pipe accommodation portion formed in a bottom surface thereof and having a recess corresponding to a shape of the refrigerant pipe to accommodate the refrigerant pipe therein, and a protrusion protruded from the bottom surface of the ice-making tray to separate the U-shaped third portion of the refrigerant pipe from the bottom surface of the ice-making tray while at least a part of the first portion and a part of the second portion is directly in contact with the bottom surface of the ice-making tray in order to decrease a contact area between the refrigerant pipe and the ice-making tray.

2. The refrigerator of claim 1, wherein the protrusion is formed at a region facing the third portion on the bottom surface of the ice-making tray.

3. The refrigerator of claim 1, wherein the ice-making tray includes:

a first tray which is in contact with the refrigerant pipe to receive cooling energy from the refrigerant pipe; and a second tray coupled to overlap a top surface of the first tray to receive cooling energy from the first tray, formed of a material having thermal conductivity lower than that of the first tray, and including an ice-making cell formed therein.

4. A refrigerator comprising:

a main body;

an ice-making chamber formed inside the main body;

an ice-making tray installed inside the ice-making chamber and to store ice generated therein;

a refrigerant pipe installed to the ice-making tray so that at least a part thereof is in contact with the ice-making tray to cool the ice-making tray to generate the ice therein; and a drain duct that is coupled to the ice-making tray to collect defrosted water of the ice-making tray, wherein the drain duct includes a coupling portion, the ice-making tray includes a coupling portion protruded from a lower portion thereof and rotatably coupled to the coupling portion of the drain duct so that the drain duct is rotatable with respect to the ice-making tray, and wherein the ice-making tray includes a rotation limiting portion protruded from the lower portion thereof and to limit a rotation of the drain duct by contacting the coupling portion of the drain duct after the drain duct is opened and rotated.

5. The refrigerator of claim 4, wherein the ice-making tray includes:

a first tray which is in contact with the refrigerant pipe to receive cooling energy from the refrigerant pipe;

a second tray coupled to overlap a top surface of the first tray to receive cooling energy from the first tray, formed of a material having thermal conductivity lower than that of the first tray, and including an ice-making cell formed therein.

6. A refrigerator comprising:

a main body;

an ice-making chamber formed inside the main body;

an ice-making tray installed inside the ice-making chamber and to store ice generated therein; and a refrigerant pipe installed to the ice-making tray so that at least a part thereof is in contact with the ice-making tray to cool the ice-making tray to generate the ice therein, wherein the ice-making tray includes:

an ice-making cell that stores ice-making water;

a temperature sensor that measures temperature of the ice-making water or the generated ice stored in the ice-making cell; and a temperature sensor accommodation portion formed at one end of the ice-making tray to accommodate the temperature sensor, and wherein the temperature sensor accommodation portion includes:

an accommodation portion formed in a groove shape and has an open upper side so that the temperature sensor is movable in or out of the accommodation portion; and an ice-making water contact portion, at least a part of a side surface thereof facing the ice-making cell is opened so that the temperature sensor accommodated in the temperature sensor accommodation portion is directly in contact with ice-making water through the ice-making water contact portion.

7. The refrigerator of claim 6, wherein the temperature sensor accommodation portion further includes a connecting portion that is provided as a path through which a wire connected to the temperature sensor extends toward an outside of the ice-making tray.

8. The refrigerator of claim 7, wherein the connecting portion is formed to extend in a direction opposite to the ice-making water contact portion.

9. The refrigerator of claim 6, wherein the ice-making tray includes:

a first tray which is in contact with the refrigerant pipe to receive cooling energy from the refrigerant pipe; and a second tray coupled to overlap a top surface of the first tray to receive cooling energy from the first tray, formed of a material having thermal conductivity lower than that of the first tray, and including the ice-making cell formed therein.

10. The refrigerator of claim 9, wherein the temperature sensor accommodation portion is formed at a position facing the ice-making cell of the second tray.

11. The refrigerator of claim 6, wherein the refrigerant pipe includes:

a first portion that extends in a length direction of the ice-making tray;

a second portion disposed in parallel to the first portion; and a third portion that connects the first portion and the second portion, and has a U shape, and wherein the ice-making tray includes a protrusion formed on a bottom surface thereof so that the third portion is spaced apart from the ice-making tray.

12. The refrigerator of claim 11, wherein the protrusion is formed at a region facing the third portion on the bottom surface of the ice-making tray.

13. The refrigerator of claim 6, further comprising a drain duct coupled to the ice-making tray to collect defrosted water of the ice-making tray, wherein the drain duct includes a coupling portion, the ice-making tray includes a coupling portion protruded from a lower portion thereof and rotatably coupled to the coupling portion of the drain duct so that the drain duct is rotatable with respect to the ice-making tray, and wherein the ice-making tray includes a rotation limiting portion protruded from the lower portion thereof and to limit a rotation of the drain duct by contacting the coupling portion of the drain duct after the drain duct is opened and rotated.

14. The refrigerator of claim 13, wherein the rotation limiting portion is formed in a radius of rotation of the drain duct.

15. The refrigerator of claim 14, wherein the rotation limiting portion is formed at an inner side surface of the ice-making tray to limit the drain duct to rotate only in a predetermined range.

16. The refrigerator of claim 6, further comprising:

an ejector that separates ice from the ice-making tray; and an ice-ejecting motor portion coupled to one side of the ice-making tray, wherein an ice-ejecting motor that rotates the ejector is installed inside the ice-ejecting motor portion, and wherein a locking step that protrudes in a side direction is formed at one side surface of the ice-ejecting motor portion, and a supporting member provided at a position corresponding to the locking step to support the locking step is formed at the ice-making tray.

17. The refrigerator of claim 16, wherein the ice-ejecting motor portion includes a screw coupling portion coupled to the ice-making tray by a fastener, and the locking step is formed to be spaced a predetermined gap from the screw coupling portion to prevent the ice-ejecting motor portion from sagging.

18. The refrigerator of claim 17, wherein the screw coupling portion and the locking step are formed at a same plane of the ice-ejecting motor portion, and a distance between the screw coupling portion and the ice-making cell is less than a distance between the locking step and the ice-making cell.

19. The refrigerator of claim 17, wherein the ice-ejecting motor portion further includes a seating guide provided so that a part of a coupling surface of the ice-making tray coupled to the screw coupling portion is seated.

20. The refrigerator of claim 19, wherein the seating guide includes a first seating guide and a second seating guide that respectively support a bottom surface and one side surface of the coupling surface of the ice-making tray coupled to the screw coupling portion.

* * * * *